US011286428B2

(12) United States Patent
Kandel et al.

(10) Patent No.: US 11,286,428 B2
(45) Date of Patent: Mar. 29, 2022

(54) SOLVENT AND TEMPERATURE ASSISTED DISSOLUTION OF SOLIDS FROM STEAM CRACKED TAR

(71) Applicant: ExxonMobil Chemical Patents Inc., Baytown, TX (US)

(72) Inventors: Kapil Kandel, Humble, TX (US); Teng Xu, Houston, TX (US); John S. Coleman, Houston, TX (US); Krystle J. Emanuele, Houston, TX (US); Frank Cheng-Yu Wang, Annandale, NJ (US); Anthony S. Mennito, Flemington, NJ (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 0 days.

(21) Appl. No.: 17/278,547

(22) PCT Filed: Oct. 18, 2019

(86) PCT No.: PCT/US2019/056896

§ 371 (c)(1),
(2) Date: Mar. 22, 2021

(87) PCT Pub. No.: WO2020/086394

PCT Pub. Date: Apr. 30, 2020

(65) Prior Publication Data

US 2021/0348064 A1 Nov. 11, 2021

Related U.S. Application Data

(60) Provisional application No. 62/750,636, filed on Oct. 25, 2018.

(30) Foreign Application Priority Data

Jan. 21, 2019 (EP) ..... 19152710

(51) Int. Cl.

| | |
|---|---|
| ***C10G 31/06*** | (2006.01) |
| ***C10G 75/04*** | (2006.01) |
| ***C10G 9/36*** | (2006.01) |
| ***C10G 55/04*** | (2006.01) |

(52) U.S. Cl.
CPC ..... *C10G 9/36* (2013.01); *C10G 55/04* (2013.01); *C10G 2300/44* (2013.01)

(58) Field of Classification Search
CPC ..... C10G 31/06; C10G 75/04
See application file for complete search history.

(56) References Cited

U.S. PATENT DOCUMENTS

| | | | | |
|---|---|---|---|---|
| 2,382,260 | A | 8/1945 | Schaad | |
| 4,579,563 | A * | 4/1986 | Burnside | C10L 1/322 241/21 |
| 5,158,668 | A | 10/1992 | Chahar et al. | |
| 5,871,634 | A | 2/1999 | Weihe et al. | |
| 2014/0061095 | A1 | 3/2014 | Beech et al. | |
| 2015/0136652 | A1 | 5/2015 | Bricker et al. | |

FOREIGN PATENT DOCUMENTS

| | | |
|---|---|---|
| DE | 4308507 | 9/1993 |
| WO | WO 2013/033590 | 3/2013 |
| WO | WO 2015/191148 | 12/2015 |
| WO | WO 2015/191236 | 12/2015 |
| WO | WO 2018/111574 | 6/2018 |

OTHER PUBLICATIONS

U.S. Appl. No. 17/045,416, filed Oct. 5, 2020 Entitled "Processing Pyrolysis Tar Particulates" Coleman et al.
U.S. Appl. No. 17/298,963, filed Jun. 2, 2021 Entitled "Solvent Control for Centrifugation of Steam Cracked Tar" Coleman et al.
U.S. Appl. No. 17/298,972, filed Jun. 2, 2021 Entitled "Temperature Control for Centrifugation of Steam Cracked Tar" Coleman et al.

* cited by examiner

*Primary Examiner* — Randy Boyer

(57) ABSTRACT

Processes for preparing a low particulate liquid hydrocarbon product are provided and include blending a tar stream containing particles with a fluid and heating to a temperature of 250° C. or greater to produce a fluid-feed mixture that contains tar, the particles, and the fluid. The fluid-feed mixture contains about 20 wt % or greater of the fluid, based on a combined weight of the tar stream and the fluid. Also, about 25 wt % to about 99 wt % of the particles in the tar stream are dissolved or decomposed when producing the fluid-feed mixture.

25 Claims, 1 Drawing Sheet

SOLVENT AND TEMPERATURE ASSISTED DISSOLUTION OF SOLIDS FROM STEAM CRACKED TAR

CROSS-REFERENCE TO RELATED APPLICATIONS

This application is a national phase application of International Application No. PCT/US2019/056896 filed Oct. 18, 2019, which claims priority to and the benefit of U.S. Provisional Application No. 62/750,636, filed Oct. 25, 2018, and European Patent Application No. 19152710.0 which was filed Jan. 21, 2019, the disclosures of all of which are incorporated herein by reference in their entireties.

FIELD OF INVENTION

Embodiments generally relate to improving hydrocarbon feedstock compatibility. More particularly, embodiments relate to processes which include blending a hydrocarbon feedstock with a utility fluid or solvent and heating the mixture to reduce the amount and/or size of particles contained in the hydrocarbon feedstock.

BACKGROUND OF INVENTION

Hydrocarbon pyrolysis processes, such as steam cracking, crack hydrocarbon feedstocks into a wide range of relatively high value molecules, including ethylene, propene, butenes, steam cracked gas oil ("SCGO"), steam cracked naphtha ("SCN"), or any combination thereof. Besides these useful products, hydrocarbon pyrolysis can also produce a significant amount of relatively low-value heavy products, such as pyrolysis tar. When the pyrolysis is produced by steam cracking, the pyrolysis tar is identified as steam-cracked tar ("SCT"). Economic viability of refining and petrochemical processes relies in part on the ability to incorporate as much of the product and residual fractions, such as SCT, into the value chain. One use of residual fractions and/or relatively low value products is to blend these fractions with other hydrocarbons, e.g., with other feedstreams or products.

SCT, however, generally contains relatively high molecular weight molecules, conventionally called Tar Heavies ("TH"), and an appreciable amount of sulfur. The presence of sulfur and TH make SCT a less desirable blendstock, e.g., for blending with fuel oil blend-stocks or different SCTs. Compatibility is generally determined by visual inspection for solids formation, e.g., as described in U.S. Pat. No. 5,871,634. Generally, SCTs have high viscosity and poor compatibility with other heavy hydrocarbons such as fuel oil, or are only compatible in small amounts. Likewise, SCTs produced under specific conditions are generally have poor compatibility with SCT produced under different conditions.

Viscosity and compatibility can be improved, and the amount of sulfur decreased, by catalytically hydroprocessing the SCT. Catalytic hydroprocessing of undiluted SCT, however, leads to appreciable catalyst deactivation and the formation of undesirable deposits (e.g., coke deposits or particles) on the reactor internals. As the amount of these deposits increases, the yield of the desired upgraded pyrolysis tar (upgraded SCT) decreases and the yield of undesirable byproducts increases. The hydroprocessing reactor pressure drop also increases, often to a point where the reactor is inoperable.

It is conventional to lessen deposit formation by hydroprocessing the SCT in the presence of a fluid, e.g., a solvent having significant aromatics content. The product of the hydroprocessing contains an upgraded SCT product that generally has a decreased viscosity, decreased atmospheric boiling point range, and increased hydrogen content over that of the feed's SCT, resulting in improved compatibility with fuel oil blend-stocks. Additionally, hydroprocessing the SCT in the presence of fluid produces fewer undesirable byproducts and the rate of increase in reactor pressure drop is lessened. Conventional processes for SCT hydroprocessing are disclosed in U.S. Pat. Nos. 2,382,260 and 5,158,668; and in International Pat. Appl. Pub. No. WO 2013/033590, which involves recycling a portion of the hydroprocessed tar for use as the fluid.

The presence solid or semi-solid material in SCT represent a significant challenge to effective SCT hydroprocessing. An appreciable amount of the SCT's solids and semi-solids are in the form of particulates, e.g., coke (such as pyrolytic coke), oligomeric and/or polymeric material, inorganic solids (e.g., fines, metal, metal-containing compounds, ash, etc.) aggregates of one or more of these, etc. Although some SCT particulates can be removed by filtration, settling, centrifuging, etc. these removal methods can significantly lengthen processing time. Moreover, the presence of particulates can impede operation of process equipment, e.g., the centrifuge and/or the primary fractionator, a cleaning step is employed to dislodge the particles, increasing time and expense while the production process is down for removing these solids.

For example, solids removal by particle settlement can be slow and/or energy intensive, leading to the presence of large molecules even after settling. These problems are worsened when using economically-attractive SCT feeds, which can contain a significant amount of solids or particulates, such as high as a total solids content of 4,000 ppm or greater, and particles sizes ranging from submicron to greater than 1,000 microns.

Thus, there is a need for improved tar conversion processes with reduced particle content in hydrocarbon feedstocks.

SUMMARY OF INVENTION

Embodiments provide processes that include the discovery to preferentially remove, particularly by controlling solvent concentration and temperature, certain higher density components (e.g., particles) in the hydrocarbon feed, in which can provide hydrocarbon feeds having reduced particle content. Controlling solvent concentration and temperature can dissolve and/or decompose (e.g., disaggregate) many, if not all, of the particles that tend to cause fouling of downstream centrifuges, hydroprocessing reactors, and other portions of the process system, allowing for improved yields by, for example, leaving non-particulate components in the lower density portion of a hydrocarbon feedstock after centrifugation.

In one or more embodiments, a process for preparing a low particulate liquid hydrocarbon product is provided and includes blending a tar stream containing particles with a fluid (such as a utility fluid and/or solvent) and heating to a temperature of 280° C. or greater to produce a fluid-feed mixture that contains tar, the particles, and the fluid. The particles or solids can be or include polymeric asphaltene particles, polymeric coke particles, pyrolytic coke particles, inorganic fines, or any combination thereof. About 25 wt % to about 99 wt % of the particles in the tar stream are dissolved or decomposed when producing the fluid-feed mixture. The fluid-feed mixture contains about 20 wt % or greater of the fluid, based on a combined weight of the tar stream and the fluid.

In some examples, the tar stream and the fluid are blended together, and prior to centrifugation, heated to a temperature of 280° C. to about 500° C., about 290° C. to about 400° C., or about 300° C. to about 350° C. to produce the fluid-feed mixture. In one or more examples, about 40 wt % to about 95 wt % or about 60 wt % to about 90 wt % of the particles in the tar stream are dissolved or decomposed when producing the fluid-feed mixture. In other examples, the fluid-feed mixture contains about 40 wt % to about 70 wt % or about 45 wt % to about 60 wt % of the fluid, based on the combined weight of the tar stream and the fluid. The fluid can be or include one or more solvents, such as benzene, toluene, ethylbenzene, trimethylbenzene, xylenes, naphthalenes, alkylnaphthalenes, tetralins, alkyltetralins, or any combination thereof. In one or more examples, the fluid contains about 20 wt % to about 80 wt % of toluene.

In some embodiments, the process can also include heat soaking the tar stream prior to blending the tar stream and the fluid. The heat soaking of the tar stream can include exposing the tar stream to steam to produce the tar stream containing a reduced reactivity tar. In other embodiments, the process can include centrifuging the fluid-feed mixture to produce a higher density portion and a lower density portion, where the lower density portion is substantially free of the particles of size greater than 25 μm.

These and other features, aspects, and advantages of the processes will become better understood from the following description, appended claims, and accompanying drawings.

DETAILED DESCRIPTION

Figure 1:
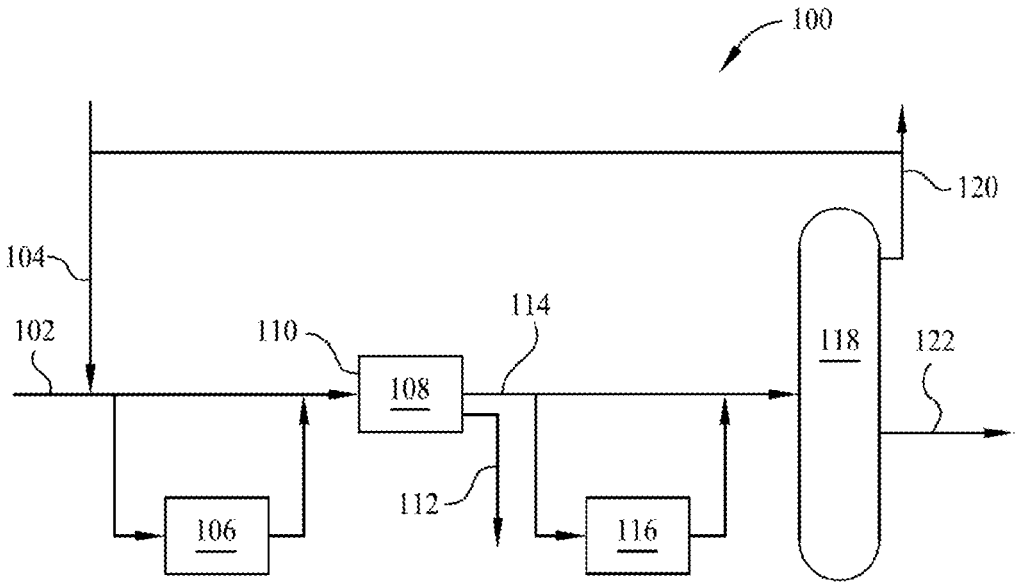
FIG. 1 depicts a process for improving hydrocarbon feedstock, according to one or more embodiments.

Embodiments provide processes that include the discovery to preferentially remove, particularly by controlling solvent concentration and temperature, certain higher density components (e.g., particles) in the hydrocarbon feed, in which can provide hydrocarbon feeds having reduced particle content. Controlling solvent concentration and temperature can dissolve and/or decompose (e.g., disaggregate) many, if not all, of the particles that tend to cause fouling of downstream centrifuges, hydroprocessing reactors, and other portions of the process system, allowing for improved yields by, for example, leaving non-particulate components in the lower density portion of a hydrocarbon feedstock after centrifugation.

In one or more embodiments, a process for preparing a low particulate liquid hydrocarbon product is provided and includes blending a tar stream containing particles with a fluid and heating to a temperature of 250° C. or greater to produce a fluid-feed mixture that contains tar, the particles, and the fluid. About 25 wt % to about 99 wt % of the particles in the tar stream are dissolved or decomposed when producing the fluid-feed mixture. The fluid-feed mixture contains about 40 wt % or greater of the utility fluid based on a combined weight of the tar stream and the fluid.

Definitions

"Hydrocarbon feed" refers to a flowable composition, e.g., liquid phase, high viscosity, and/or slurry compositions, which (i) includes carbon bound to hydrogen and (ii) has a mass density greater than that of gasoline, typically ≥0.72 Kg/L, e.g., ≥0.8 Kg/L, such as ≥0.9 Kg/L, or ≥1.0 Kg/L, or ≥1.1 Kg/L. Such compositions can include one or more of crude oil, crude oil fraction, and compositions derived therefrom which (i) have a kinematic viscosity $\leq 1.5\times10^3$ cSt at 50° C., (ii) contain carbon bound to hydrogen, and (iii) have a mass density ≥740 kg/m$^3$. Hydrocarbon feeds typically have a final boiling point at atmospheric pressure ("atmospheric boiling point", or "normal boiling point") ≥430° F. (220° C.). Certain hydrocarbon feeds include components having an atmospheric boiling point ≥290° C., e.g., hydrocarbon feeds containing ≥20% (by weight) of components having an atmospheric boiling point ≥290° C., e.g., ≥50%, such as ≥75%, or ≥90%. Certain hydrocarbon feeds appear to have the color black or dark brown when illuminated by sunlight, including those having a luminance ≤7 cd/m$^2$, luminance being measured in accordance with CIECAM02, established by the Commission Internationale de l'éclairage. Non-limiting examples of such feeds include pyrolysis tar, SCT, vacuum residual fracturing, atmospheric residual fracturing, vacuum gas oil ("VGO"), atmospheric gas oil ("AGO"), heavy atmospheric gas oil ("HAGO"), steam cracked gas oil ("SCGO"), deasphalted oil ("DAO"), cat cycle oil ("CCO", including light cat cycle oil, "LCCO", and heavy cat cycle oil, "HCCO"), natural and synthetic feeds derived from tar sands, or shale oil, coal.

"SCT" means (a) a mixture of hydrocarbons having one or more aromatic components and optionally (b) non-aromatic and/or non-hydrocarbon molecules, the mixture being derived from hydrocarbon pyrolysis and having a 90% Total Boiling Point ≥550° F. (290° C.) (e.g., ≥90.0 wt % of the SCT molecules have an atmospheric boiling point ≥550° F. (290° C.)). SCT can contain ≥50.0 wt % (e.g., ≥75.0 wt %, such as ≥90.0 wt %), based on the weight of the SCT, of hydrocarbon molecules (including mixtures and aggregates thereof) having (i) one or more aromatic components and (ii) a number of carbon atoms ≥15. SCT generally has a metals content, $\leq 1.0\times10^3$ ppmw, based on the weight of the SCT (e.g., an amount of metals that is far less than that found in crude oil (or crude oil components) of the same average viscosity). SCT typically has a mass density ≥1.0 Kg/L, e.g., ≥1.05 Kg/L, such as ≥1.1 Kg/L, or ≥1.15 Kg/L.

"Solvent assisted tar conversion" or ("SATC") is a process for producing an upgraded tar, such as SCT. The process includes hydroprocessing a tar stream in the presence of a utility fluid, and is generally described in P.C.T. Patent Application Publication No. WO 2018/111577. For example, SATC can include hydroprocessing one or SCT streams, including those that have been subjected to prior pretreatments, in the presence of a utility fluid, to produce a hydroprocessed tar having a lesser viscosity, improved blending characteristics, fewer heteroatom impurities, and a lesser content of solids and semi-solids (e.g., fewer particles) as compared to the SCT feed.

"Tar Heavies" ("TH") means a product of hydrocarbon pyrolysis, typically included in a pyrolysis tar such as steam cracker tar. The TH typically have an atmospheric boiling point >565° C., and contain >5 wt % of molecules having a plurality of aromatic cores based on the weight of the tar. The TH are typically solid at 25° C. and generally include the fraction of SCT that is not soluble in a 5:1 (vol:vol) ratio of n-pentane:SCT at 25° C. TH generally includes asphaltenes and other high molecular weight molecules.

"Pyrolytic coke" or "pyrolytic coke particles" means a material generated by pyrolysis of organic molecules present in steam cracker tar and/or quench oils. The pyrolytic coke is in solid or particle form.

"Polymeric coke" or "polymeric coke particles" means a material generated by oligomerization of olefinic molecules that can seed small foulant particles. The olefinic molecules can be present in steam cracker tar and/or quench oils. The polymeric coke material or particles typically have a specific gravity of about 1.04 to about 1.1, which is much less than the specific gravity of about 1.2 to about 1.3 for coke solids (non-polymeric materials) typically found in tar.

"Particles" means a solid material or semi-solid material in particulate form and can be or include polymeric asphaltene particles, polymeric coke particles, pyrolytic coke particles, inorganic fines, other organic or inorganic particles, or any combination thereof. Particles present in tar typically have a specific gravity from about 1.04 to about 1.5. When a particulate content (whether by weight, volume, or number) of a flowable material, such as tar or upgraded tar, is compared with that of another flowable material, the comparison is made under substantially the same conditions, e.g., substantially the same temperature, pressure, etc. When samples of flowable materials are obtained from a process for comparison elsewhere, e.g., in a laboratory, the particulate content comparison can be carried out (i) under conditions which simulate the process conditions and/or (ii) under ambient conditions, e.g., a temperature of 25° C. and a pressure of 1 bar (absolute).

"Solubility blending number (S)" and "insolubility number (I)" are described in U.S. Pat. No. 5,871,634, incorporated herein by reference in its entirety, and determined using n-heptane as the so-called "nonpolar, nonsolvent" and chlorobenzene as the solvent. The S and I numbers are determined at a weight ratio of oil to test liquid mixture in the range of from 1 to 5. Various such values are referred to herein. For example, "$I_{feed}$" refers to the insolubility number of the hydrocarbon feed; "$I_{LD}$" refers to the insolubility number of the lower density portion separated from the hydrocarbon feed; "$I_{HD}$" refers to the insolubility number of the higher density portion separated from the hydrocarbon feed; "$I_{treated}$" refers to the insolubility number of the treated portion obtained from the lower density portion; "$I_{product}$" refers to the insolubility number of the hydroprocessed product; "$S_{FO}$" refers to the solubility blending number of the fuel oil blend-stock; and "$S_{fluid}$" refers to the solubility blending number of the fluid or the fluid-enriched stream, as appropriate. In conventional notation, these I and S values are frequently identified as $I_N$ and $S_{BN}$.

The terms "higher density portion" and "lower density portion" are relative terms meaning that a higher density portion has a mass density ($\rho_2$) that is higher than the density of the lower density portion ($\rho_1$), e.g., $\rho_2 \geq 1.01*\rho_1$, such as $\rho_2 \geq 1.05*\rho_1$, or $\rho_2 \geq 1.10*\rho_1$. In some aspects, the higher density portion contains primarily solid components and the lower density portion contains primarily liquid phase components. The higher density component may also include liquid phase components that have segregated from the lower density portion. Likewise, the lower-density portion can contain solids or semi-solids (even in particulate form), e.g., those having a density similar to that of the tar feed's liquid hydrocarbon component.

The term "portion" generally refers to one or more components derived from the fluid-feed mixture.

Except for its use with respect to parts-per-million, the term "part" is used with respect to a designated process stream, generally indicating that less than the entire designated stream may be selected.

The Hydrocarbon Feed

The hydrocarbon feed may contain one or more hydrocarbon feeds described above, particularly tar streams (e.g., heat-treated, cracked, or uncracked), SCT, residual fractures, or combinations thereof. Generally, the hydrocarbon feed has an Insolubility number, $I_{feed} \geq 20$, e.g., ≥30, ≥40, ≥50, ≥60, ≥70, ≥80, ≥90, ≥100, ≥110, ≥120, ≥130, ≥140, or ≥150. Additionally or alternatively, the insolubility number of the feed may be ≤150, e.g., ≤140, ≤130, ≤120 ≤110, ≤100, ≤90, ≤80, ≤70, ≤60, ≤50, ≤40, or ≤30. Ranges expressly disclosed include combinations of any of the above-enumerated values; e.g., about 20 to about 150, about 30 to about 150, about 40 to about 150, about 50 to about 150, about 60 to about 150, about 70 to about 150, about 80 to about 150, about 90 to about 150, about 100 to about 150, about 110 to about 150, about 120 to about 150, about 130 to about 150, or about 140 to about 150. Particular hydrocarbon feeds, e.g., certain SCTs, have an insolubility number, $I_{feed}$, of about 90 to about 150, about 100 to about 150, about 110 to about 150, about 120 to about 150, or about 130 to about 150. For other hydrocarbon feeds, e.g., residual fractures, the $I_{feed}$ may be about 20 to about 90, about 30 to 80, or about 40 to about 70. In certain aspects, the hydrocarbon feed has a mass density ≥0.93 g/mL, e.g., ≤0.94 g/mL, such as ≤0.95 g/mL, or ≤0.96 g/mL, e.g., in the range of 0.93 to 0.97 g/mL.

In certain aspects, it is desirable to utilize as a feed an SCT having little or no olefin content, particularly in aspects where one or more components of the fluid-feed mixture, e.g., the lower density portion or a part thereof, is subjected to hydroprocessing after separation. It is observed that the rate of reactor pressure-drop increase across the hydroprocessing reactor is lessened when utilizing an SCT having a lesser olefin content, e.g., a lesser content of vinyl aromatics. For example, in certain aspects the amount of olefin the SCT is ≤10 wt %, e.g., ≤5 wt %, such as ≤2 wt %, based on the weight of the SCT. More particularly, the amount of (i) vinyl aromatics in the SCT and/or (ii) aggregates in the SCT which incorporate vinyl aromatics is generally ≤5 wt %, e.g., ≤3 wt %, such as ≤2 wt %, based on the weight of the SCT.

Embodiments are compatible with hydrocarbon feeds having a relatively high sulfur content, e.g., ≥0.1 wt %, based on the weight of the SCT, such as ≥1, or ≥2 wt %, or in the range of 0.5 wt % to 7 wt %. High sulfur content is not needed, and relatively low sulfur-content SCT can be used, e.g., SCT having a sulfur content <0.1 wt %, based on the weight of the SCT, e.g., ≤0.05 wt %, such as ≤0.01 wt %. Hydrocarbon feeds having (i) a lesser olefin content and/or (ii) a higher sulfur content, and methods for producing such feeds, are disclosed in U.S. Pat. No. 9,809,756, which is incorporated by reference herein in its entirety.

The Fluid-Feed Mixture

The hydrocarbon feed, such as one or more tar streams or cracked tar stream, is combined by any suitable method with one or more fluids to form a fluid-feed mixture. The fluid can be or include one or more utility fluids and/or one or more solvents. The fluid-feed mixture generally contains ≥5 wt % of the hydrocarbon feed, e.g., ≥10 wt %, ≥20 wt %, ≥30 wt %, ≥40 wt %, ≥50 wt %, ≥60 wt %, ≥70 wt %, ≥80 wt %, or ≥90 wt % hydrocarbon feed, based on the total weight of the fluid-feed mixture (e.g., a combined weight of the tar stream and the (utility) fluid). Additionally or alternatively, the fluid-feed mixture may include ≤10 wt % hydrocarbon feed, e.g., ≤20 wt %, ≤30 wt %, ≤40 wt %, ≤50 wt %, ≤60 wt %, ≤70 wt %, ≤80 wt %, ≤90 wt %, or ≤95 wt % hydrocarbon feed, based on the total weight of the fluid-feed mixture (e.g., a combined weight of the tar stream and the (utility) fluid). Ranges expressly disclosed include combinations of any of the above-enumerated values, e.g., about 5 wt % to about 95 wt %, about 5 wt % to about 90 wt %, about 5 wt % to about 80 wt %, about 5 wt % to about 70 wt %, about 5 wt % to about 60 wt %, about 5 wt % to about 50 wt %, about 5 wt % to about 40 wt %, about 5 wt % to about 30 wt %, about 5 wt % to about 20 wt %, or about 5 wt % to about 10 wt % hydrocarbon feed.

In addition to the hydrocarbon feed, the fluid-feed mixture generally contains ≥5 wt % fluid, e.g., ≥10 wt %, ≥20 wt %, ≥30 wt %, ≥40 wt %, ≥50 wt %, ≥60 wt %, ≥70 wt %, ≥80 wt %, or ≥90 wt %, based on the total weight of the fluid-feed mixture (e.g., a combined weight of the tar stream and the (utility) fluid). Additionally or alternatively, the fluid-feed mixture may include ≤10 wt % fluid, e.g., ≤20 wt %, ≤30 wt %, ≤40 wt %, ≤50 wt %, ≤60 wt %, ≤70 wt %, ≤80 wt %, ≤90 wt %, or ≤95 wt % fluid, based on the total weight of the fluid-feed mixture (e.g., a combined weight of the tar stream and the (utility) fluid). Ranges expressly disclosed include combinations of any of the above-enumerated values, e.g., about 5 wt % to about 95 wt %, about 5 wt % to about 90 wt %, about 5 wt % to about 80 wt %, about 5 wt % to about 70 wt %, about 5 wt % to about 60 wt %, about 5 wt % to about 50 wt %, about 5 wt % to about 40 wt %, about 5 wt % to about 30 wt %, about 5 wt % to about 20 wt %, or about 5 wt % to about 10 wt % fluid.

In one or more embodiments, the tar stream (e.g., cracked or uncracked tar) is blended, mixed, or otherwise combined with one or more utility fluids or solvents to produce the fluid-feed mixture. The fluid-feed mixture has a reduced viscosity relative to the tar stream. In some examples, the fluid-feed mixture contains the tar, the particles, and the fluid. The fluid-feed mixture contains about 15 wt %, about 20 wt %, about 25 wt %, 30 wt %, about 35 wt %, about 40 wt %, about 45 wt %, or about 50 wt % to about 55 wt %, about 60 wt %, about 65 wt %, about 70 wt %, about 75 wt %, about 80 wt %, about 85 wt %, or about 90 wt %, or more of the fluid, based on a combined weight of the tar stream and the (utility) fluid. For example, the fluid-feed mixture contains about 15 wt % to about 90 wt %, about 20 wt % to about 90 wt %, about 20 wt % to about 80 wt %, about 20 wt % to about 70 wt %, about 20 wt % to about 60 wt %, about 20 wt % to about 50 wt %, about 20 wt % to about 50 wt %, about 20 wt % to about 40 wt %, about 20 wt % to about 30 wt %, about 25 wt % to about 90 wt %, about 30 wt % to about 85 wt %, about 30 wt % to about 80 wt %, about 35 wt % to about 80 wt %, about 40 wt % to about 80 wt %, about 40 wt % to about 75 wt %, about 40 wt % to about 70 wt %, about 40 wt % to about 65 wt %, about 40 wt % to about 60 wt %, about 40 wt % to about 55 wt %, about 40 wt % to about 50 wt %, about 40 wt % to about 45 wt %, about 45 wt % to about 80 wt %, about 45 wt % to about 75 wt %, about 45 wt % to about 70 wt %, about 45 wt % to about 65 wt %, about 45 wt % to about 60 wt %, about 45 wt % to about 55 wt %, about 45 wt % to about 50 wt %, about 50 wt % to about 80 wt %, about 50 wt % to about 75 wt %, about 50 wt % to about 70 wt %, about 50 wt % to about 65 wt %, about 50 wt % to about 60 wt %, about 50 wt % to about 55 wt %, about 55 wt % to about 80 wt %, about 55 wt % to about 75 wt %, about 55 wt % to about 70 wt %, about 55 wt % to about 65 wt %, or about 55 wt % to about 60 wt % of the fluid, based on a combined weight of the tar stream and the (utility) fluid.

In other embodiments, the tar stream, the utility fluids or solvent, and/or the fluid-feed mixture can independently be heated during and/or after producing the fluid-feed mixture to produce a heated fluid-feed mixture. The heating dissolves or decomposes the particles, or otherwise reduces particle content, contained in the tar stream. The tar stream and/or the utility fluid can be heated before being combined and/or the fluid-feed mixture can independently be heated to a desired temperature and for a desired period of time. The fluid-feed mixture can be heated to achieve a temperature of about 200° C., about 220° C., about 230° C., about 240° C., about 250° C., about 260° C., about 270° C., about 275° C., about 280° C., or about 290° C. to about 295° C., about 300° C., about 310° C., about 320° C., about 325° C., about 330° C., about 340° C., about 350° C., about 360° C., about 375° C., about 400° C., about 450° C., about 500° C., or higher. For example, the fluid-feed mixture can be heated to a temperature of about 200° C. to about 500° C., about 230° C. to about 500° C., about 250° C. to about 500° C., about 280° C. to about 500° C., about 290° C. to about 500° C., about 300° C. to about 500° C., about 320° C. to about 500° C., about 350° C. to about 500° C., about 250° C. to about 450° C., about 280° C. to about 450° C., about 290° C. to about 450° C., about 300° C. to about 450° C., about 320° C. to about 450° C., about 350° C. to about 450° C., about 250° C. to about 400° C., about 280° C. to about 400° C., about 290° C. to about 400° C., about 300° C. to about 400° C., about 320° C. to about 400° C., about 350° C. to about 400° C., about 250° C. to about 350° C., about 280° C. to about 350° C., about 290° C. to about 350° C., about 300° C. to about 350° C., about 320° C. to about 350° C., or about 330° C. to about 350° C. After achieving the predetermined specified temperature, the fluid-feed mixture can be maintained at or above that temperature for a time of one minute or more, such as in a range of about 2 min, about 5 min, about 10 min, about 12 min, or about 15 min to about 20 min, about 25 min, about 30 min, about 45 min, about 60 min, about 90 min, about 2 hr, about 3 hr, about 5 hr, or longer. For example, the fluid-feed mixture can be heated at the predetermined temperature for about 5 min to about 5 hr, about 5 min to about 3 hr, about 5 min to about 2 hr, about 5 min to about 1 hr, about 5 min to about 45 min, about 5 min to about 30 min, or about 5 min to about 20 min. In one or more examples, the fluid-feed mixture is heated to the predetermined temperature for about 2 min, about 5 min, about 10 min, about 15 min, or about 20 min to about 30 min, about 45 min, about 60 min, about 90 min, about 2 hr, about 3 hr, or about 5 hr to dissolve and/or decompose the particles.

Once heated at the predetermined temperature and for the predetermined time, the heated fluid-feed mixture contains fewer particles than prior to heating the fluid-feed mixture or the tar stream. The heating dissolves or decomposes the particles, or otherwise reduces particle content, contained in the fluid-feed mixture that contains fewer particles. In one or more embodiments, about 25 wt %, about 30 wt %, about 35 wt %, or about 40 wt % to about 45 wt %, about 50 wt %, about 60 wt %, about 70 wt %, about 75 wt %, about 80 wt %, about 85 wt %, about 90 wt %, about 92 wt %, about 95 wt %, about 97 wt %, about 98 wt %, about 99 wt %, or more of the particles in the tar stream are dissolved or decomposed when producing the fluid-feed mixture. In some examples, at least 25 wt %, at least 30 wt %, at least 35 wt %, at least 40 wt %, at least 45 wt %, at least 50 wt %, at least 60 wt %, at least 70 wt %, at least 75 wt %, at least 80 wt % to about 85 wt %, about 90 wt %, about 92 wt %, about 95 wt %, about 97 wt %, about 98 wt %, about 99 wt %, or more of the particles in the tar stream are dissolved or decomposed when producing the fluid-feed mixture. For example, about 25 wt % to about 99 wt %, about 30 wt % to about 99 wt %, about 35 wt % to about 99 wt %, about 40 wt % to about 99 wt %, about 45 wt % to about 99 wt %, about 50 wt % to about 99 wt %, about 60 wt % to about 99 wt %, about 70 wt % to about 99 wt %, about 75 wt % to about 99 wt %, about 25 wt % to about 95 wt %, about 30 wt % to about 95 wt %, about 35 wt % to about 95 wt %, about 40 wt % to about 95 wt %, about 45 wt % to about 95 wt %, about 50 wt % to about 95 wt %, about 60 wt % to about 95 wt %, about 70 wt % to about 95 wt %, about 75 wt % to about 95 wt %, about 25 wt % to about 90 wt %, about 30 wt % to about 90 wt %, about 35 wt % to about 90 wt %, about 40 wt % to about 90 wt %, about 45 wt % to about 90 wt %, about 50 wt % to about 90 wt %, about 60 wt % to about 90 wt %, about 70 wt % to about 90 wt %, about 75 wt % to about 90 wt %, about 25 wt % to about 80 wt %, about 30 wt % to about 80 wt %, about 35 wt % to about 80 wt %, about 40 wt % to about 80 wt %, about 45 wt % to about 80 wt %, about 50 wt % to about 80 wt %, about 60 wt % to about 80 wt %, about 70 wt % to about 80 wt %, or about 75 wt % to about 80 wt % of the particles in the tar stream are dissolved or decomposed when producing the fluid-feed mixture.

In some aspects, the heated fluid-feed mixture has a solubility blending number of less than 150, such as about 140 or less, about 130 or less, about 120 or less, as about 115 or less, about 110 or less, about 105 or less, about 100 or less, about 95 or less, or about 90 or less. In some examples, the heated fluid-feed mixture has a solubility blending number of about 70, about 80, about 85, about 90, about 95, about 100, about 105, about 110, about 115, about 120, about 130, about 140, or about 150. For example, the heated fluid-feed mixture has a solubility blending number of about 70 to about 150, about 70 to about 130, about 70 to about 125, about 70 to about 120, about 70 to about 115, about 70 to about 110, about 70 to about 105, about 70 to about 100, about 70 to about 95, about 70 to about 90, about 70 to about 85, about 80 to about 130, about 80 to about 125, about 80 to about 120, about 80 to about 115, about 80 to about 110, about 80 to about 105, about 80 to about 100, about 80 to about 95, about 80 to about 90, about 85 to about 130, about 85 to about 125, about 85 to about 120, about 85 to about 115, about 85 to about 110, about 85 to about 105, about 85 to about 100, about 85 to about 95, about 85 to about 90, about 90 to about 130, about 90 to about 125, about 90 to about 120, about 90 to about 115, about 90 to about 110, about 90 to about 105, about 90 to about 100, or about 90 to about 95.

Generally, the fluid includes the utility fluid and/or a separation fluid. It can be beneficial for the fluid to contain utility fluid, such as in aspects which include hydroprocessing one or more fluid-feed mixture components after exposing the fluid-feed mixture to a centrifugal force. In some aspects, the fluid can contain ≥65 wt % utility fluid, e.g., ≥75 wt %, ≥80 wt %, ≥85 wt %, ≥90 wt %, or ≥95 wt % utility fluid, based on the total weight of the fluid in the fluid-feed mixture. Additionally or alternatively, the fluid may contain ≤100 wt % utility fluid, e.g., ≤95 wt %, ≤90 wt %, ≤85 wt %, ≤80 wt %, ≤75 wt %, or ≤70 wt % utility fluid, based on the total weight of the fluid in the fluid-feed mixture. Ranges expressly disclosed include combinations of any of the above-enumerated values, e.g., about 65 to about 100 wt %, about 75 to about 100 wt %, about 80 to about 100 wt %, about 85 to about 100 wt %, about 90 to about 100 wt %, or about 95 to about 100 wt % utility fluid.

The fluid may optionally include a separation fluid, typically in an amount of ≤35 wt %, e.g., ≤30 wt %, ≤25 wt %, ≤20 wt %, ≤15 wt %, ≤10 wt %, ≤5 wt %, ≤2.5 wt %, or ≤1.5 wt %, based on the total weight of fluid in the fluid-feed mixture. Additionally or alternatively, the separation fluid may be present in an amount ≥ to 0 wt %, e.g., ≥1.5 wt %, ≥2.5 wt %, ≥5 wt %, ≥10 wt %, ≥15 wt %, ≥20 wt %, ≥25 wt %, or ≥30 wt %, based on the total weight of the fluid in the fluid-feed mixture. Ranges include combinations of any of the above-enumerated values, e.g., 0 to about 35 wt %, 0 to about 30 wt %, 0 to about 25 wt %, 0 to about 20 wt %, 0 to about 15 wt %, 0 to about 10 wt %, 0 to about 5 wt %, 0 to about 2.5 wt %, 0 to about 1.5 wt % separation fluid, based on the total weight of fluid in the fluid-feed mixture.

Particularly in aspects where fluid-feed mixture components are not subjected to subsequent hydroprocessing, the fluid may contain primarily a separation fluid. Thus, in some aspects, the fluid may contain ≥50 wt % separation fluid, e.g., ≥60 wt %, ≥70 wt %, ≥80 wt %, ≥90 wt %, ≥95 wt %, ≥97.5 wt %, ≥99 wt %, or about 100 wt % separation fluid, based on the total weight of the fluid-feed mixture. Additionally or alternatively, the fluid-feed mixture may include ≤99 wt % separation fluid, e.g., ≤97.5 wt %, ≤95 wt%, ≤90 wt %, ≤80 wt %, ≤70 wt %, or ≤60 wt % separation fluid, based on the total weight of the fluid-feed mixture. Ranges expressly disclosed include combinations of any of the above-enumerated values, e.g., about 50 wt % to about 100 wt %, about 60 wt % to about 100 wt %, about 70 wt % to about 100 wt %, about 80 wt % to about 100 wt %, about 90 wt % to about 100 wt %, about 95 wt % to about 100 wt %, about 97.5 wt % to about 100 wt %, or about 99 wt % to about 100 wt % separation fluid.

The dynamic viscosity of the fluid-feed mixture can be less than that of the hydrocarbon feed. In some aspects, the dynamic viscosity of the fluid-feed mixture may be ≥0.5 cPoise, e.g., ≥1 cPoise, ≥2.5 cPoise, ≥5 cPoise, ≥7.5 cPoise, at a temperature of about 50° C. to about 250° C., such as about 100° C. Additionally or alternatively, the dynamic viscosity of the fluid-feed mixture may be ≤10 cPoise, e.g., ≤7.5 cPoise, ≤5 cPoise, ≤2.5 cPoise, ≤1 cPoise, ≤0.75 cPoise, at a temperature of about 50° C. to about 250° C., such as about 100° C. Ranges can include combinations of any of the above-enumerated values, e.g., about 0.5 cPoise to about 10 cPoise, about 1 cPoise to about 10 cPoise, about 2.5 cPoise to about 10 cPoise, about 5 cPoise to about 10 cPoise, or about 7.5 cPoise to about 10 cPoise, at a temperature of about 50° C. to about 250° C., such as about 100° C.

The Utility Fluid

Conventional utility fluids can be used, such as those used as a process aid for hydroprocessing tar such as SCT, but the invention is not limited thereto. Suitable utility fluids include those disclosed in U.S. Provisional Patent Application No. 62/716,754; U.S. Pat. Nos. 9,090,836; 9,637,694; and 9,777,227; and 9,809,756; and International Patent Application Publication No. WO 2018/111574, these being incorporated by reference herein in their entireties. The utility fluid typically comprises ≥40 wt %, of at least one aromatic or non-aromatic ring-containing compound, e.g., ≥45 wt %, ≥50 wt %, ≥55 wt %, or ≥60 wt %, based on the weight of the utility fluid. Particular utility fluids contain ≥40 wt %, ≥45 wt %, ≥50 wt %, ≥55 wt %, or ≥60 wt % of at least one multi-ring compound, based on the weight of the utility fluid. The compounds contain a majority of carbon and hydrogen atoms, but can also contain a variety of substituents and/or heteroatoms.

In certain aspects, the utility fluid contains aromatics, e.g., ≥70 wt % aromatics, based on the weight of the utility fluid, such as ≥80 wt %, or ≥90 wt %. Typically, the utility fluid contains ≤10 wt % of paraffin, based on the weight of the utility fluid. For example, the utility fluid can contain ≥95 wt % of aromatics, ≤5 wt % of paraffin. Optionally, the utility fluid has a final boiling point ≤750° C. (1,400° F.), e.g., ≤570° C. (1,050° F.), such as ≤430° C. (806° F.). Such utility fluids can contain ≥25 wt % of 1-ring and 2-ring aromatics (e.g., those aromatics having one or two rings and at least one aromatic core), based on the weight of the utility fluid. Utility fluids having a relatively low final boiling point can be used, e.g., a utility fluid having a final boiling point ≤400° C. (750° F.). The utility fluid can have an 10% (weight basis) total boiling point ≥120° C., e.g., ≥140° C., such as ≥150° C. and/or a 90% total boiling point ≤430° C., e.g., ≤400° C. Suitable utility fluids include those having a true boiling point distribution generally in the range of from 175° C. (350° F.) to about 400° C. (750° F.). A true boiling point distribution can be determined, e.g., by conventional methods such as the method of A.S.T.M. D7500, which can be extended by extrapolation when the true boiling point distribution has a final boiling point that is outside the range encompassed by the A.S.T.M. method. In certain aspects, the utility fluid has a mass density ≤0.91 g/mL, e.g., ≤0.90 g/mL, such as ≤0.89 g/mL, or ≤0.88 g/mL, e.g., in the range of 0.87 g/mL to 0.90 g/mL.

The utility fluid can be or include one or more solvents, such as one or more recycle solvents, one or more mid-cut solvents, one or more virgin solvents, or any combination thereof. The utility fluid typically contains aromatics, e.g., ≥95 wt % aromatics, such as ≥99 wt %. For example, the utility fluid contains ≥95 wt %, based on the weight of the utility fluid, one or more of benzene, ethylbenzene, trimethylbenzene, xylenes, toluene, naphthalenes, alkylnaphthalenes (e.g., methylnaphtalenes), tetralins, or alkyltetralins (e.g., methyltetralins), e.g., ≥99 wt %, such as ≥99.9 wt %. It is generally desirable for the utility fluid to be substantially free of molecules having alkenyl functionality, particularly in aspects utilizing a hydroprocessing catalyst having a tendency for coke (e.g., pyrolytic and/or polymeric coke particles) formation in the presence of such molecules. In certain aspects, the supplemental utility fluid contains ≤10 wt % of ring compounds having $C_1$-$C_6$ sidechains with alkenyl functionality, based on the weight of the utility fluid.

In one or more embodiments, the utility fluid contains toluene in a concentration of about 10 wt %, about 20 wt %, about 30 wt %, or about 40 wt % to about 50 wt %, about 60 wt %, about 70 wt %, about 80 wt %, about 90 wt %, about 95 wt %, about 98 wt %, or about 100 wt %. For example, the utility fluid contains about 10 wt % to about 90 wt %, about 20 wt % to about 90 wt %, about 30 wt % to about 90 wt %, about 40 wt % to about 90 wt %, about 50 wt % to about 90 wt %, about 60 wt % to about 90 wt %, about 20 wt % to about 80 wt %, about 30 wt % to about 80 wt %, about 40 wt % to about 80 wt %, about 50 wt % to about 80 wt %, about 60 wt % to about 80 wt %, about 20 wt % to about 60 wt %, about 30 wt % to about 60 wt %, about 40 wt % to about 60 wt %, about 50 wt % to about 60 wt %, about 60 wt % to about 70 wt %, about 20 wt % to about 50 wt %, about 30 wt % to about 50 wt %, or about 40 wt % to about 50 wt % of toluene.

Certain solvents and solvent mixtures can be included in the utility fluid, including steam cracked naphtha ("SCN"), SCGO, and/or other solvent containing aromatics, such as those solvents containing ≥90 wt %, e.g., ≥95 wt %, such as ≥99 wt % of aromatics, based on the weight of the solvent. Representative aromatic solvents that are suitable for use as utility fluid include A200 solvent, available from ExxonMobil Chemical Company (Houston Tex.), CAS number 64742-94-5. In one or more aspects, the utility fluid (i) has a critical temperature in the range of 285° C. to 400° C., and (ii) contains aromatics, including alkyl-functionalized derivatives thereof. For example, the specified utility fluid can contain ≥90 wt % of a single-ring aromatic, including those having one or more hydrocarbon substituents, such as from 1 to 3 or 1 to 2 hydrocarbon substituents. Such substituents can be any hydrocarbon group that is consistent with the overall solvent distillation characteristics. Examples of such hydrocarbon groups include, but are not limited to, those selected from the group consisting of $C_1$-$C_6$ alkyl, wherein the hydrocarbon groups can be branched or linear and the hydrocarbon groups can be the same or different. Optionally, the specified utility fluid contains ≥90 wt % based on the weight of the utility fluid of one or more of benzene, ethylbenzene, trimethylbenzene, xylenes, toluene, naphthalenes, alkylnaphthalenes (e.g., methylnaphtalenes), tetralins, or alkyltetralins (e.g., methyltetralins).

Although not critical, typically the utility fluid can be one that is substantially free of molecules having terminal unsaturates, for example, vinyl aromatics, particularly in aspects utilizing a hydroprocessing catalyst having a tendency for coke formation in the presence of such molecules. The term "substantially free" in this context means that the utility fluid contains ≤10 wt % (e.g., ≤5 wt % or ≤1 wt %) vinyl aromatics, based on the weight of the utility fluid.

Where hydroprocessing is envisioned, the utility fluid typically contains sufficient amount of molecules having one or more aromatic cores to effectively increase run length of the tar hydroprocessing process. For example, the utility fluid can contain ≥50 wt % of molecules having at least one aromatic core (e.g., ≥60 wt %, such as ≥70 wt %) based on the total weight of the utility fluid. In an aspect, the utility fluid contains (i) ≥60 wt % of molecule having at least one aromatic core and (ii) ≤1 wt % of vinyl aromatics, the weight percent being based on the weight of the utility fluid.

The utility fluid can have a high solvency, as measured by solubility blending number ("$S_{Fluid}$"). For example, the utility fluid can have a $S_{Fluid}$≥90, e.g., ≥100, ≥110, ≥120, ≥150, ≥175, or ≥200. Additionally or alternatively, $S_{Fluid}$ can be ≤200, e.g., ≤175, ≤150, ≤125, ≤110, or ≤100. Range values for the $S_{Fluid}$ expressly disclosed include combinations of any of the above-enumerated values; e.g., 90 to about 200, about 100 to about 200, about 110 to about 200, about 120 to about 200, about 150 to about 200, or about 175 to about 200. Exemplary fluids include A200, A150, and A-100, available from ExxonMobil Chemical Company. Particular Exemplary fluids are described in U.S. Pat. No. 9,777,227, incorporated by reference herein in its entirety. Steam cracker gas oil, which typically has a solubility blend number of about 100, and LCCO, typically having a solubility blending number of about 120, may also be used.

Additionally or alternatively, the utility fluid may be characterized by a dynamic viscosity of that is typically less than that of the fluid-feed mixture. In some aspects, the dynamic viscosity of the fluid-feed mixture may be ≥0.1 cPoise, e.g., ≥0.5 cPoise, ≥1 cPoise, ≥2.5 cPoise or, ≥4 cPoise, at a temperature of about 50° C. to about 250° C., such as about 100° C. Additionally or alternatively, the dynamic viscosity of the fluid-feed mixture may be ≤5 cPoise, e.g., ≤4 cPoise, ≤2.5 cPoise, ≤1 cPoise, ≤0.5 cPoise, or ≤0.25 cPoise, at a temperature of about 50° C. to about 250° C., such as about 100° C. Ranges expressly disclosed include combinations of any of the above-enumerated values, e.g., about 0.1 to about 5 cPoise, about 0.5 cPoise to about 5 cPoise, about 1 cPoise to about 5 cPoise, about 2.5 cPoise to about 5 cPoise, or about 4 cPoise to about 5 cPoise, at a temperature of about 50° C. to about 250° C., such as about 100° C. In some aspects, the dynamic viscosity of the utility fluid is adjusted so that when combined with the hydrocarbon feed to produce the fluid-feed mixture, particles having a size larger than 25 μm settle out of the fluid-feed mixture to provide the solids-enriched portion (the extract) and particulate-depleted portions (the raffinate) described herein, more particularly to adjust the viscosity to also enable the amount of solids removal and throughput of the particle-depleted portion from the process.

The Separation Fluid

The separation fluid can be any hydrocarbon liquid, typically a non-polar hydrocarbon, or mixture thereof. In some aspects, the separation fluid may be a paraffinic hydrocarbon or a mixture or paraffinic hydrocarbons. Particular paraffinic fluids include $C_5$ to $C_{20}$ hydrocarbons and mixtures thereof, particularly $C_5$ to $C_{10}$ hydrocarbons, e.g. hexane, heptane, and octane. Such fluids may be particularly useful when subsequent hydroprocessing is not desired. In certain aspects, the separation fluid has a mass density ≤0.91 g/mL, e.g., ≤0.90 g/mL, such as ≤0.89 g/mL, or ≤0.88 g/mL, e.g., in the range of 0.87 to 0.90 g/mL.

Separating the Higher Density and Lower Density Portions

After heating, a higher-density portion and a lower-density portion can be separated from the heated fluid-feed mixture. The heated feed-fluid mixture can be cooled (e.g., to a achieve a temperature ≤280° C.) before the separation is carried out, but this is not required. In some aspects, the fluid-feed mixture may be separated by sedimentation, filtration, extraction, or any combination thereof. Conventional separations technology can be utilized, but embodiments are not limited thereto. For example, the lower density portion may be separated by decantation, filtration and/or boiling point separation (e.g., one or more distillation towers, splitters, flash drums, or any combination thereof). The higher density portion may be separated in a similar manner, e.g., by removing the higher density portion from the separation stage as a bottoms portion. In some aspects, the fluid-feed mixture is separated by exposing the fluid-feed mixture to a centrifugal force, e.g., by employing one or more centrifuges in the separation stage. In some embodiments, processes employ centrifuge separations in the separation stage will now be described in more detail. Embodiments are not limited to these aspects, as well as this description is not to be interpreted as foreclosing the use of additional and/or alternative separations technologies, such as those that do not involve exposing the fluid-feed mixture to a centrifugal force.

Inducing the Centrifugal Force

In some aspects, the fluid-feed mixture containing the cracked tar, the particles (e.g., pyrolytic coke, polymeric coke, and/or inorganics), and the utility fluid is provided to a centrifuge for exposing the fluid-feed mixture to a centrifugal force sufficient to form at least a higher density portion and a lower density portion. Typically, the fluid-feed mixture in the centrifuge exhibits a substantially uniform circular motion as a result of an applied central force. Depending on reference-frame choice, the central force can be referred to as a centrifugal force (in the reference-frame of the fluid-feed mixture) or a centripetal force (in the reference frame of the centrifuge). The particulars of the centrifuge design and operation are not critical. The process may be performed in a batch, semi-batch or continuous manner.

The centrifuge may be configured to apply heat to the fluid-feed mixture, e.g., by heating the fluid-feed mixture to an elevated temperature. In some aspects, inducing the centrifugal force also includes heating the fluid-feed mixture to a temperature of about 20° C., about 25° C., about 30° C., about 40° C., about 50° C., about 55° C., or about 60° C. to about 65° C., about 70° C., about 80° C., about 85° C., about 90° C., about 95° C., about 100° C., about 110° C., about 120° C., or greater. For example, while centrifuging, the fluid-feed mixture can be heated to a temperature of about 20° C. to about 120° C., about 20° C. to about 100° C., about 30° C. to about 100° C., about 40° C. to about 100° C., about 50° C. to about 100° C., about 60° C. to about 100° C., about 70° C. to about 100° C., about 80° C. to about 100° C., about 90° C. to about 100° C., about 20° C. to about 80° C., about 30° C. to about 80° C., about 40° C. to about 80° C., about 50° C. to about 80° C., about 60° C. to about 80° C., or about 70° C. to about 80° C.

The centrifugal force may be applied for any amount of time. Typically the centrifugal force is applied for ≥1 minute, e.g., ≥5 minutes, ≥10 minutes, ≥30 minutes, ≥60 minutes, or ≥120 minutes. Additionally or alternatively, the centrifugal force may be applied for ≤120 minutes, ≤60 minutes, ≤30 minutes, ≤10 minutes, or ≤5 minutes. Ranges expressly disclosed include combinations of any of the above-enumerated values; e.g., about 1 minute to about 120 minutes, about 5 minutes to about 120 minutes, about 10 minutes to about 120 minutes, about 30 minutes to about 120 minutes, or about 60 minutes to about 120 minutes. The centrifugal force may be applied for any amount of force or speed. For example, a sufficient force will be provided by a centrifuge operating at about 1,000 rpm to about 10,000 rpm, about 2,000 rpm to about 7,500 rpm, or about 3,000 rpm to about 5,000 rpm.

Centrifuging the fluid-feed mixture typically results in separating from the fluid-feed mixture at least (i) an extract containing a higher density portion of the fluid-feed mixture and (ii) a raffinate or a lower density portion. In other words, exposing the fluid-feed mixture to the centrifugal force results in the removal of at least the higher density portion (the extract) from the fluid-feed mixture. When the process is operated continuously or semi-continuously, at least two streams can be conducted away from the centrifuging: one stream containing the extract and another stream containing the raffinate. Centrifuges with such capabilities are commercially available.

Typically centrifuging is sufficient to segregate ≥80 wt %, ≥90 wt %, ≥95 wt %, ≥99 wt % of solids having size ≥2 μm, e.g., ≥10 μm, ≥20 μm, or ≥25 μm, into the higher density portion (e.g., the extract), the wt % being based on the total weight of solids in the higher density and lower density portions. Where subsequent hydroprocessing of the raffinate is envisioned, the higher density portion contains ≥95 wt %, particularly ≥99 wt %, of solids having a size of ≥25 μm, particularly, ≥20 μm, ≥10 μm, or ≥2 μm. In other aspects, e.g., where the lower density portion (e.g., the raffinate) is not subjected to hydroprocessing, filtration should be sufficient to segregate at least 80 wt % of the solids into the higher density portion.

While the description focuses on a higher density portion and a lower density portion, other embodiments envision that the components of the fluid-feed mixture may be more discretely segregated and extracted, e.g., very light components segregating to the top of the mixture, a portion that contains primarily the fluid therebelow, an upgraded tar portion, tar heavies, or solids at the bottom of the centrifuge chamber. Each of these portions, or combinations thereof, may be selectively removed from the mixture as one or more raffinates. Typically, the higher density portion discussed below is selected to extract undesired tar heavies and solid components, while the lower density portion includes the remainder.

The Higher Density Portion

In certain aspects, a higher density portion and a lower density portion are separated, from the heated feed-fluid mixture. The higher density portion typically has a substantially liquid-phase part and a substantially solid-phase part. The liquid-phase part can have, e.g., an insolubility number, $I_{HD}$, ≥20, ≥40, ≥70, ≥90, ≥100, ≥110, ≥120, ≥130, ≥140, or ≥150. Additionally or alternatively, $I_{HD}$, may be ≤40, ≤70, ≤90, ≤100, ≤110, ≤120, ≤130, ≤140, or ≤150. Ranges expressly disclosed include combinations of any of the above-enumerated values; e.g., about 20 to about 150, about 40 to about 150, about 70 to about 150, about 90 to about 150, about 100 to about 150, about 110 to about 150, about 120 to about 150, about 130 to about 150, or about 140 to about 150.

Additionally or alternatively, the higher density portion can contain asphaltenes and/or tar heavies, which may be (i) present (e.g., dissolved and/or suspended) in the substantially liquid-phase part, and/or (ii) present (e.g., as precipitate) in the substantially-solid part. In some aspects, the higher density portion, particularly the liquid portion thereof, contains ≥50 wt % asphaltenes, e.g., ≥60 wt %, ≥75 wt %, based on the total weight of the higher density portion. The higher density portion may include ≤10 wt %, e.g., ≤7.5 wt %, ≤5 wt %, ≤2.5 wt %, ≤2 wt %, ≤1.5 wt %, or ≤1 wt %, of the total asphaltene content of the hydrocarbon feed. The higher density portion may include ≥1 wt %, e.g., ≥1.5 wt %, ≥2 wt %, ≥2.5 wt %, ≥5 wt %, or ≥7.5 wt %, of the total asphaltene content of the hydrocarbon feed. Ranges expressly disclosed include combinations of any of the above-enumerated values; e.g., 1 wt % to 10 wt %, 1 wt % to 7.5 wt %, 1 wt % to 5 wt %, 1 wt % to 2.5 wt %, 1 wt % to 2 wt %, or 1 wt % to 1.5 wt % of the total asphaltene content of the hydrocarbon feed. Removal of lower amounts of the asphaltene content may be preferred. For example, it has been surprisingly found that the segregation of even small amounts of asphaltenes into the higher density portion has a surprisingly favorable impact on the insolubility number of the lower density portion. While not wishing to be bound by any theory or model, it is believed that the presence of relatively high-density asphaltenes in the hydrocarbon feed have a much greater impact on insolubility number than do lower-density asphaltenes. Thus, a relatively large amount of problematic molecules can be separated, leaving in the lower density portion molecules that will contribute to the over-all yield of a relatively higher-value product.

The benefits of the process may be obtained even when the higher density portion contains a relatively small fraction of the hydrocarbon feed. The higher density portion may contain ≤10 wt %, e.g., ≤7.5 wt %, ≤5 wt %, ≤2.5 wt %, ≤2 wt %, ≤1.5 wt %, or ≤1 wt % of the total weight of the hydrocarbon feed. Ranges expressly disclosed include combinations of any of the above-enumerated values; e.g., 1 wt % to 10 wt %, 1 wt % to 7.5 wt %, 1 wt % to 5 wt %, 1 wt % to 2.5 wt %, 1 wt % to 2 wt %, or 1 wt % to 1.5 wt % of the total weight of the hydrocarbon feed. The removal of a relatively small weight fraction may surprisingly be accompanied by a relatively large improvement in the insolubility number of the lower density portion. The particulates present in the extract typically have a mass density ≥1.05 g/mL, e.g., ≥1.10 g/mL, such as ≥1.2 g/mL, or ≥1.3 g/mL. Typically ≥50 wt. % of particles in the heated fluid-feed mixture having a mass density ≥1.05 g/mL (e.g., ≥1.10 g/mL, such as ≥1.2 g/mL, or ≥1.3 g/mL) are transferred to the extract, e.g., ≥75 wt. %, such as ≥90 wt. %, or ≥90 wt. %.

In other words, it has surprisingly been found that a fluid-feed mixture comprising the specified hydrocarbon feed and the specified amount of the specified utility fluid when heated (e.g., by heating the tar, the utility fluid, and/or the fluid-feed mixture) to achieve a temperature of the tar-fluid mixture ≥2800 for at least one minute results in dissolving (and/or decomposing) about 25 wt % to about 99 wt % of the tar's particles. Moreover, it has been found that transferring to the extract ≥50 wt. % of particles in the heated fluid-feed mixture having a density ≥1.05 g/mL achieves an appreciable improvement in the lower-density portion's insolubility number as compared to processes in the heating the specified heating of the fluid-feed mixture is not carried out. Surprisingly, this benefit is achieved even when the higher density portion contains a relatively small fraction of the hydrocarbon feed, e.g., ≤10 wt %. It had been thought that such an improvement in the lower density portion's insolubility number would have required a transfer to the higher-density portion of at least 50 wt % of the hydrocarbon feed or more, and would undesirably result in a very low yield of the lower-density portion. It is also observed that ≥90 wt. % of particles of size greater than 25 μm in the heated fluid-feed mixture are transferred to the higher-density portion, e.g., ≥95 wt. %, or ≥99 wt. %. While not wishing to be bound by any theory or model, it is believed that this benefit results, at least in part, by transferring to the higher density portion ≥50 wt. % of particles in the heated fluid feed mixture that (i) have a density ≥1.05 g/mL and (ii) have a size of at least 25 μm.

The Lower Density Portion

The lower density portion is generally removed from the separation stage as raffinate, which can be conducted away for one or more of storage, blending with other hydrocarbons, or further processing. The lower density portion generally has a desirable insolubility number, e.g., an insolubility number that is less than that of the hydrocarbon feed and/or less than that of the higher density portion. Typically, the insolubility number of the lower density portion ($I_{LD}$) is ≥20, e.g., ≥30, ≥40, ≥50, ≥60, ≥70, ≥80, ≥90, ≥100, ≥110, ≥120, ≥130, ≥140, or ≥150. Additionally or alternatively, the $I_{LD}$ may be ≤150, e.g., ≤140, ≤130, ≤120≤110, ≤100, ≤90, ≤80, ≤70, ≤60, ≤50, ≤40, or ≤30. Ranges expressly disclosed include combinations of any of the above-enumerated values; e.g., about 20 to about 150, about 20 to about 140, about 20 to about 130, about 20 to about 120, about 20 to about 110, about 20 to about 100, about 20 to about 90, about 20 to about 80, about 20 to about 70, about 20 to about 60, about 20 to about 50, about 20 to about 40, or about 20 to about 30. Those skilled in the art will appreciate that hydrocarbon separations technology is imperfect, and, consequently, a small amount of solids may be present in the lower density portion, e.g., an amount of solids that is ≤0.1 times the amount of solids in the fluid-feed mixture, such as ≤0.01 times. In aspects where at least part of the lower density portion is hydroprocessed, solids-removal means (e.g., one or more filters) are typically employed between the separation stage and the hydroprocessing stage.

The ratio of the insolubility number of the lower density portion, $I_{LD}$, to the insolubility number of the hydrocarbon feed, $I_{feed}$, is ≤0.95, e.g., ≤0.90, ≤0.85, ≤0.80, ≤0.75, ≤0.70, ≤0.65, ≤0.60, ≤0.55, ≤0.50, ≤0.40, ≤0.30, ≤0.20, or ≤0.10. Additionally or alternatively, the ratio of $I_{LD}$ to $I_{feed}$ may be ≥0.10, e.g., ≥0.20, ≥0.30, ≥0.40, ≥0.50, ≥0.55, ≥0.60, ≥0.65, ≥0.70, ≥0.75, ≥0.80, ≥0.85, or ≥0.90. Ranges expressly disclosed include combinations of any of the above-enumerated values, e.g., about 0.10 to 0.95, about 0.20 to 0.95, about 0.30 to 0.95, about 0.40 to 0.95, about 0.50 to 0.95, about 0.55 to 0.95, about 0.60 to 0.95, about 0.65 to 0.95, about 0.70 to 0.95, about 0.75 to 0.95, about 0.80 to 0.95, about 0.85 to 0.95, or about 0.90 to 0.95.

The Treated Portion

Typically it is desired to recover the fluid, e.g., for recycle and re-use in the process. Fluid can be recovered as a second raffinate from the separation stage, or alternatively/additionally can be separated from the first raffinate (e.g., the lower density portion) in a second separation stage located downstream of the first separation stage. For example, the fluid may optionally be separated from the lower density portion to form a treated portion of the hydrocarbon. Any suitable separation means may be used. For example, the fluid may be separated by fractionation, such as in one or more distillation towers, or by vapor-liquid separation, such as by one or more vapor-liquid separators. Alternatively, the fluid may be separated via one or more flash drums, splitters, fractionation towers, membranes, absorbents, or any combination thereof, though the method is not limited thereto. The recovered fluid recovered for further use, e.g., for recycle to the process.

The treated portion may have an insolubility number, $I_{treated}$, ≥20, e.g., ≥30 ≥40, ≥50, ≥60, ≥70, ≥80, ≥90, ≥100, ≥110, ≥120, ≥130, ≥140, ≥150. Additionally or alternatively, the insolubility number of the treated portion may be ≤150, e.g., ≤140, ≤130, ≤120, ≤110, ≤100, ≤90, ≤80, ≤70, ≤60, ≤50, ≤40, or ≤30. Ranges expressly disclosed include combinations of any of the above-enumerated values; e.g., about 20 to about 150, about 20 to about 140, about 20 to about 130, about 20 to about 120, about 20 to about 110, about 20 to about 100, about 20 to about 90, about 20 to about 80, about 20 to about 70, about 20 to about 60, about 20 to about 50, about 20 to about 40, or about 20 to about 30.

The ratio of the insolubility number of the treated portion, $I_{treated}$, to the insolubility number of the hydrocarbon feed, $I_{feed}$, is ≤0.95, e.g., ≤0.90, ≤0.85, ≤0.80, ≤0.75, ≤0.70, ≤0.65, ≤0.60, ≤0.55, ≤0.50, ≤0.40, ≤0.30, ≤0.20, or ≤0.10. Additionally or alternatively, the $I_{treated}$:$I_{feed}$ ratio may be ≥0.10, e.g., ≥0.20, ≥0.30, ≥0.40, ≥0.50, ≥0.55, ≥0.60, ≥0.65, ≥0.70, ≥0.75, ≥0.80, ≥0.85, or ≥0.90. Ranges expressly disclosed include combinations of any of the above-enumerated value, e.g., about 0.10 to 0.95, about 0.20 to 0.95, about 0.30 to 0.95, about 0.40 to 0.95, about 0.50 to 0.95, about 0.55 to 0.95, about 0.60 to 0.95, about 0.65 to 0.95, about 0.70 to 0.95, about 0.75 to 0.95, about 0.80 to 0.95, about 0.85 to 0.95, or about 0.90 to 0.95.

Hydroprocessing

Additionally or alternatively, at least part of (i) the lower density portion and/or (ii) the treated portion may be provided to a hydroprocessing unit, effectively increasing run-length of the hydroprocessing unit. Typically, the fluid is not separated from the raffinate prior to hydroprocessing. In other words, except for solids-removal, at least part of the raffinate can be conducted from a first separation stage to the hydroprocessor without any intervening processing or separating. The amount of fluid in the raffinate during hydroprocessing may be in the range of from about 5 wt % to about 80 wt % fluid, based on the weight of the raffinate, e.g., about 10 wt % to about 80 wt %, such as about 10 wt % to about 60 wt %.

Hydroprocessing of the lower density portion can occur in one or more hydroprocessing stages, the stages containing one or more hydroprocessing vessels or zones. Vessels and/or zones within the hydroprocessing stage in which catalytic hydroprocessing activity occurs generally include at least one hydroprocessing catalyst. The catalysts can be mixed or stacked, such as when the catalyst is in the form of one or more fixed beds in a vessel or hydroprocessing zone.

Conventional hydroprocessing catalyst can be utilized for hydroprocessing the lower density portion, such as those specified for use in residual fracturing and/or heavy oil hydroprocessing, but the method is not limited thereto. Suitable hydroprocessing stages, catalysts, process conditions, and pretreatments include those disclosed in P.C.T. Patent Application Publication Nos. WO2018/111574, WO2018/111576, and WO2018/111577, which are incorporated by reference herein in their entireties. Conventional hydroprocessing catalyst(s) can be utilized for hydroprocessing the lower density portion, such as those specified for use in residual fracturing and/or heavy oil hydroprocessing, but the method is not limited thereto. Suitable hydroprocessing catalysts include those containing (i) one or more bulk metals and/or (ii) one or more metals on a support. The metals can be in elemental form or in the form of a compound. In one or more aspects, the hydroprocessing catalyst includes at least one metal from any of Groups 5 to 10 of the Periodic Table of the Elements (tabulated as the Periodic Chart of the Elements, The Merck Index, Merck & Co., Inc., 1996). Examples of such catalytic metals include, but are not limited to, vanadium, chromium, molybdenum, tungsten, manganese, technetium, rhenium, iron, cobalt, nickel, ruthenium, palladium, rhodium, osmium, iridium, platinum, or mixtures thereof. In one or more aspects, the catalyst is a bulk multimetallic hydroprocessing catalyst with or without binder. In one or more embodiments, the catalyst is a bulk trimetallic catalyst that contains two Group 8 metals, such as Ni and Co and one Group 6 metal, such as Mo. Conventional hydrotreating catalysts can be used, but the method is not limited thereto. In certain aspects, the catalysts include one or more of KF860 available from Albemarle Catalysts Company LP, Houston Tex.; Nebula® Catalyst, such as Nebula® 20, available from the same source; Centera® catalyst, available from Criterion Catalysts and Technologies, Houston Tex., such as one or more of DC-2618, DN-2630, DC-2635, and DN-3636; Ascent® Catalyst, available from the same source, such as one or more of DC-2532, DC-2534, and DN-3531; and FCC pretreat catalyst, such as DN3651 and/or DN3551, available from the same source. However, the method is not limited to only these catalysts.

Hydroprocessing the lower density portion (e.g., the raffinate) leads to improved catalyst life, e.g., allowing the hydroprocessing stage to operate for at least 3 months, or at least 6 months, or at least 1 year without replacement of the catalyst in the hydroprocessing or contacting zone. Since catalyst life is generally lengthened when heavy hydrocarbon is hydroprocessed in the presence of utility fluid, e.g., >10 times longer than would be the case if no utility fluid were utilized, it is generally desirable to recover utility fluid (e.g., for recycle and reuse) from the hydroprocessor effluent instead of from the hydroprocessor feed.

The amount of coking in the hydroprocessing or contacting zone is relatively small and run lengths are relatively long as indicated by relatively a small increase in reactor pressure drop over its start-of-run ("SOR") value, as calculated by ([Observed pressure drop−Pressure $drop_{SOR}$]/Pressure $drop_{SOR}$)*100%. The increase in pressure drop may be ≤10.0%, ≤5.0%, ≤2.5%, or ≤1.0%. Additionally or alternatively, the hydroprocessing reactor's increase in pressure drop compared to its SOR value may be ≤30 psi (2 bar), e.g., ≤25 psi (1.7 bar), ≤20 psi (1.3 bar), ≤15 psi (1.0 bar), ≤10 psi (0.7 bar), or ≤5 psi (0.3 bar), ≥1.0 psi (0.07 bar), ≥5.0 psi (0.3 bar), ≥10.0 psi (0.7 bar), ≥15.0 psi (1.0 bar), ≥20.0 psi (1.3 bar), or ≥25.0 psi (1.7 bar). Ranges of the pressure drop expressly disclosed include all combinations of these values, e.g., 1.0 to 30 psi (0.07 bar to 2 bar), 1.0 to 25.0 psi (0.07 bar to 1.7 bar), 1.0 to 20.0 psi (0.07 bar to 1.3 bar), 1.0 to 15.0 psi (0.07 bar to 1.0 bar), 1.0 to 10.0 psi (0.07 bar to 0.7 bar), or 1.0 to 5.0 psi (0.07 bar to 0.3 bar). The pressure drop may be determined between any two convenient times, $T_1$ and $T_2$. $T_1$ is typically the time associated with the SOR value. $T_2$ may be any arbitrary time thereafter. Thus, the observed pressure drop may be determined over a period, $T_2-T_1$, ≥30 days ≥50 days, ≥75 days, ≥100 days, ≥125 days, ≥150 days, ≥175 days, ≥200 days, ≥250 days, ≥300 days, ≥350 days, ≥400 days, ≥450 days, ≥500 days, ≥550 days, ≥600 days, ≥650 days, or ≥700 days or more.

The hydroprocessing is carried out in the presence of hydrogen, e.g., by (i) combining molecular hydrogen with the tar stream and/or fluid upstream of the hydroprocessing and/or (ii) conducting molecular hydrogen to the hydroprocessing stage in one or more conduits or lines. Although relatively pure molecular hydrogen can be utilized for the hydroprocessing, it is generally desirable to utilize a "treat gas" which contains sufficient molecular hydrogen for the hydroprocessing and optionally other species (e.g., nitrogen and light hydrocarbons such as methane) which generally do not adversely interfere with or affect either the reactions or the products. Unused treat gas can be separated from the hydroprocessed product for re-use, generally after removing undesirable impurities, such as $H_2S$ and $NH_3$. The treat gas optionally contains ≥50 vol % of molecular hydrogen, e.g., ≥75 vol %, based on the total volume of treat gas conducted to the hydroprocessing stage.

Optionally, the amount of molecular hydrogen supplied to the hydroprocessing stage is in the range of from about 300 SCF/B (standard cubic feet per barrel) (53 standard cubic meter of treat gas per cubic meter of feed, "S $m^3/m^3$") to 5,000 SCF/B (890 S $m^3/m^3$), in which B refers to barrel of feed to the hydroprocessing stage. For example, the molecular hydrogen can be provided in a range of from 1,000 SCF/B (178 S $m^3/m^3$) to 3,000 SCF/B (534 S $m^3/m^3$). Hydroprocessing the lower density portion, molecular hydrogen, and a catalytically effective amount of the specified hydroprocessing catalyst under catalytic hydroprocessing conditions produce a hydroprocessed effluent. An example of suitable catalytic hydroprocessing conditions will now be described in more detail. Embodiments are not limited to these conditions, and this description is not meant to foreclose other hydroprocessing conditions within the broader scope of the embodiments.

The hydroprocessing is generally carried out under hydroconversion conditions, e.g., under conditions for carrying out one or more of hydrocracking (including selective hydrocracking), hydrogenation, hydrotreating, hydrodesulfurization, hydrodenitrogenation, hydrodemetallation, hydrodearomatization, hydroisomerization, or hydrodewaxing of the specified tar stream. The hydroprocessing reaction can be carried out in at least one vessel or zone that is located, e.g., within a hydroprocessing stage downstream of the pyrolysis stage and separation stage. The lower density portion including the fluid generally contacts the hydroprocessing catalyst in the vessel or zone, in the presence of molecular hydrogen. Catalytic hydroprocessing conditions can include, e.g., exposing the feed to the hydroprocessing reactor to temperature in the range from 50° C. to 500° C. or from 200° C. to 450° C. or from 220° C. to 430° C. or from 350° C. to 420° C. proximate to the molecular hydrogen and hydroprocessing catalyst. For example, a temperature in the range of from 300° C. to 500° C., or 350° C. to 430° C., or 360° C. to 420° C. can be utilized. Liquid hourly space velocity (LHSV) of the lower density portion will generally range from 0.1 to 30 $h^{-1}$, or 0.4 to 25 $h^{-1}$, or 0.5 $h^{-1}$ to 20 $h^{-1}$. In some aspects, LHSV is at least 5 $h^{-1}$, or at least 10 $h^{-1}$, or at least 15 $h^{-1}$. Molecular hydrogen partial pressure during the hydroprocessing is generally in the range of from 0.1 MPa to 8 MPa, or 1 MPa to 7 MPa, or 2 MPa to 6 MPa, or 3 MPa to 5 MPa. In some aspects, the partial pressure of molecular hydrogen is ≤7 MPa, or ≤6 MPa, or ≤5 MPa, or ≤4 MPa, or ≤3 MPa, or ≤2.5 MPa, or ≤2 MPa. The hydroprocessing conditions can include, e.g., one or more of a temperature in the range of 300° C. to 500° C., a pressure in the range of 15 bar (absolute) to 135 bar, or 20 bar to 120 bar, or 20 bar to 100 bar, a space velocity (LHSV) in the range of 0.1 to 5.0, and a molecular hydrogen consumption rate of about 53 S $m^3/m^3$ to about 445 S $m^3/m^3$ (300 SCF/B to 2,500 SCF/B, where the denominator represents barrels of the tar stream, e.g., barrels of SCT). In one or more aspects, the hydroprocessing conditions include one or more of a temperature in the range of 380° C. to 430° C., a pressure in the range of 21 bar (absolute) to 81 bar (absolute), a space velocity in the range of 0.2 to 1.0, and a hydrogen consumption rate of about 70 S $m^3/m^3$ to about 267 S $m^3/m^3$ (400 SCF/B to 1,500 SCF/B). When operated under these conditions using the specified catalyst, hydroconversion conversion is generally ≥25% on a weight basis, e.g., ≥50%.

In certain aspects, the hydroprocessed effluent contains (i) a liquid phase including recoverable fluid and hydroprocessed product, and (ii) a vapor phase including light hydrocarbon gases such as methane, unconverted molecular hydrogen, heteroatom gases such as hydrogen sulfide. The vapor phase is typically separated and conducted away from the hydroprocessed product as an overhead stream. Typically, the vapor phase contains about 5 wt % of the total liquid feed to the reactor. Recoverable fluid can be separated from the hydroprocessed effluent, e.g., for reuse in the process. The recoverable fluid can have, e.g., substantially the same composition and true boiling point distribution as the utility fluid. In certain aspects, the recoverable fluid contains ≥70 wt % of aromatics, ≤10 wt % of paraffins, and having a final boiling point ≤750° C., e.g., ≤510° C., such as ≤430° C. After separation of the recoverable fluid, the remainder of the liquid phase contains a hydroprocessed product having generally desirable blending characteristics compared to those of the hydrocarbon feed.

Initiation of hydroprocessing may also include the use of a primer fluid as described in U.S. Pat. No. 9,777,227, e.g., until sufficient recoverable fluid is available for recycle and reuse. It has been surprisingly discovered that, after a startup transition period, the hydroprocessing process equilibrates so that sufficient fluid to sustain the process (e.g., without any make-up or supplemental fluid from a source external to the process) may be obtained as recoverable fluid from the hydroprocessed effluent.

The Hydroprocessed Effluent

In certain aspects, at least the following components are separated from the hydroprocessed effluent: (i) an overhead stream and (ii) a fluid-enriched stream containing recoverable fluid, and a hydroprocessed product. The hydroprocessed product is typically, but not necessarily, removed from the liquid-phase portion of the hydroprocessed effluent as a bottoms fraction. The overhead contains from 0 wt % to about 20 wt % of the hydroprocessed effluent. The fluid-enriched stream contains from about 20 wt % to about 70 wt % of the hydroprocessed effluent. The hydroprocessed product contains from about 20 wt % to about 70 wt % of the hydroprocessed effluent.

In other aspects, the overhead stream contains from about 5 wt % to about 10 wt % of the hydroprocessed effluent. The fluid-enriched stream contains from about 30 wt % to about 60 wt % of the hydroprocessed effluent. The hydroprocessed product contains from about 30 wt % to about 70 wt % of the hydroprocessed effluent.

The overhead stream, the fluid-enriched stream, and hydroprocessed product can be separated by any separation means, including conventional separations means, e.g., one or more flash drums, splitters, fractionation towers, membranes, absorbents, or any combination thereof, though embodiments are not limited thereto. Fractionation, for example, may be accomplished in one or more distillation towers, or by vapor-liquid separation, for example, by one or more vapor-liquid separators. Describing the separated portions of the hydroprocessed effluent as the overhead stream, the fluid-enriched stream, and hydroprocessed product is not intended to preclude separation in any order or by any particular method of separation. For example, components of the overhead stream and the fluid-enriched stream may be initially separated from the hydroprocessed product as a single stream via a flash drum overhead leaving the desired hydroprocessed product as a flash drum bottoms phase. The overhead and the fluid-enriched stream may later be separated from each other according to any convenient method and the overhead may optionally be carried away for further processing.

The Hydroprocessed Product Portion of the Hydroprocessed Effluent

The hydroprocessed product has an insolubility number, $I_{product}$, less than that of (i) the hydrocarbon feed and typically (ii) less than that of the lower density portion. In some aspects, the insolubility number, $I_{product}$, of the hydroprocessed product may be ≥20, e.g., ≥30, ≥40, ≥50, ≥60, ≥70, ≥80, ≥90, ≥100, ≥110, ≥120, ≥130, ≥140, or ≥150. Additionally or alternatively, $I_{product}$ may be ≤150, e.g., ≤140, ≤130, ≤120, ≤110, ≤100, ≤90, ≤80, ≤70, ≤60, ≤50, ≤40, or ≤30. Ranges expressly disclosed include combinations of any of the above-enumerated values; e.g., about 20 to about 150, about 20 to about 140, about 20 to about 130, about 20 to about 120, about 20 to about 110, about 20 to about 100, about 20 to about 90, about 20 to about 80, about 20 to about 70, about 20 to about 60, about 20 to about 50, about 20 to about 40, or about 20 to about 30.

The ratio of the insolubility number of the hydroprocessed product, $I_{product}$, to the insolubility number of the hydrocarbon feed, $I_{feed}$, may be ≤0.90, e.g., ≤0.85, ≤0.80, ≤0.75, ≤0.70, ≤0.65, ≤0.60, ≤0.55, ≤0.50, ≤0.40, ≤0.30, ≤0.20, or ≤0.10. Additionally or alternatively, the ratio may be ≥0.10, e.g., ≥0.20, ≥0.30, ≥0.40, ≥0.50, ≥0.55, ≥0.60, ≥0.65, ≥0.70, ≥0.75, ≥0.80, or ≥0.85. Ranges expressly disclosed include combinations of any of the above-enumerated values; e.g., about 0.10 to 0.90, about 0.20 to 0.90, about 0.30 to 0.90, about 0.40 to 0.90, about 0.50 to 0.90, about 0.55 to 0.90, about 0.60 to 0.90, about 0.65 to 0.90, about 0.70 to 0.90, about 0.75 to 0.90, about 0.80 to 0.90, or about 0.85 to 0.90.

The ratio of the insolubility number of the hydroprocessed product, $I_{product}$, to the insolubility number of the lower density portion, $I_{LD}$, may be ≤0.95, e.g., ≤0.90, ≤0.85, ≤0.80, ≤0.75, ≤0.70, ≤0.65, ≤0.60, ≤0.55, ≤0.50, ≤0.40, ≤0.30, ≤0.20, or ≤0.10. Additionally or alternatively, ratio may be ≥0.10, e.g., ≥0.20, ≥0.30, ≥0.40, ≥0.50, ≥0.55, ≥0.60, ≥0.65, ≥0.70, ≥0.75, ≥0.80, or ≥0.85. Ranges expressly disclosed include combinations of any of the above-enumerated values; e.g., about 0.10 to about 0.95, about 0.20 to about 0.95, about 0.30 to about 0.95, about 0.40 to about 0.95, about 0.50 to about 0.95, about 0.55 to about 0.95, about 0.60 to about 0.95, about 0.65 to about 0.95, about 0.70 to about 0.95, about 0.75 to about 0.95, about 0.80 to about 0.95, about 0.85 to about 0.95, or about 0.90 to about 0.95.

Blending

One or more of the portions described herein (e.g., lower density portion, treated portion, or hydroprocessed product) or one or more parts thereof, may be designated for blending with a second hydrocarbon, e.g., a heavy hydrocarbon such as one or more fuel oil blend-stocks. When a part of a portion is designated for blending, the part is typically obtained by dividing a stream of the portion, and designating one of the divided streams for blending. Typically all of the "parts" of a stream have substantially the same composition. In some aspects, the fuel oil blend-stock and designated stream are selected such that the difference between the solubility blending number of the fuel oil-blend-stock, $S_{FO}$, and the insolubility number of the designated stream (e.g., $I_{LD}$, $I_{treated}$, or $I_{product}$ as the case may be) is ≥5 e.g., ≥10, ≥20, or ≥30 or more. Additionally or alternatively, the difference may be ≤30, e.g., ≤20, ≤10. Ranges expressly disclosed include combinations of any of the above-enumerated values; e.g., about 5 wt % to about 30, about 10 to about 30, or about 20 to about 30. In some aspects, the fuel oil blend stock has a solubility blend number, $S_{FO}$, of ≥50, e.g., ≥60, ≥75, ≥85, ≥90, ≥95, or ≥100. Additionally or alternatively, $S_{FO}$ may be ≤100, e.g., ≤95, ≤90, ≤85, ≤75, or ≤60. Ranges of $S_{FO}$ can include combinations of any of the above-enumerated values, e.g., about 50 to about 100, about 60 to about 100, about 75 to about 100, about 85 to about 100, about 90 to about 100, or about 95 to 100. Non-limiting examples of fuel oil blend stocks suitable for blending with the lower density portion (with or without the fluid) include one or more of bunker fuel, burner oil, heavy fuel oil (e.g., No. 5 or No. 6 fuel oil), high-sulfur fuel oil, low-sulfur fuel oil, regular-sulfur fuel oil (RSFO), and the like. Optionally, trim molecules may be separated, for example, in a fractionator, from bottoms or overhead or both and added to the fluid as desired. The mixture of the fuel oil blend-stock and the desired portion further processed in any manner.

The amount of designated stream that may be included in the blend is not particular. In some aspects, e.g., where the designated stream includes lower density portion, treated portion, and/or hydroprocessed product, the amount of the lower density portion, treated portion, and/or hydroprocessed product may be ≥5 wt %, e.g., ≥10 wt %, ≥20 wt %, ≥30 wt %, ≥40 wt %, ≥50 wt %, ≥60 wt %, ≥70 wt %, ≥80 wt %, or ≥90 wt % or more. Additionally, or alternatively, the amount of the lower density portion, treated portion, and/or hydroprocessed product that may be included in the blend may be ≤80 wt %, ≤70 wt %, ≤60 wt %, ≤50 wt %, ≤40 wt %, ≤30 wt %, ≤20 wt %, or ≤10 wt %. Expressly disclosed ranges of the amount include combinations of any of the above-enumerated values, e.g., about 5 wt % to about 90 wt %, about 10 wt % to about 90 wt %, about 20 wt % to about 90 wt %, about 30 wt % to about 90 wt %, about 40 wt % to about 90 wt %, about 50 wt % to about 90 wt %, about 60 wt % to about 90 wt %, about 70 wt % to about 90 wt %, or about 80 wt % to about 90 wt %. All amounts are based on the total weight the lower density portion, treated portion, and/or hydroprocessed product, as the case may be, that does not form solids in the blend containing the lower density portion, treated portion, and/or hydroprocessed product and the fuel oil blend-stock. In other words, blending the designated stream with the second hydrocarbon does not typically result in asphaltene precipitation, and the blends are generally substantially free of precipitated asphaltenes. Since the higher-density asphaltenes, the ones believed to have a particularly adverse effect on feed hydrocarbon blending, are typically less numerous than the more innocuous lower density asphaltenes, the relative amount of the lower density portion, treated portion, and/or hydroprocessed product may be surprisingly high in some cases, compared to the amount of higher density portion.

Certain aspects will now be described with reference to one or more of the Figures. Thus, FIG. 1 schematically illustrates features of a process 100. In process 100, a hydrocarbon feed is provided via feed line 102. The hydrocarbon feed can be or include a tar stream or a cracked tar stream (e.g., SCT). For example, a tar stream can be heat soaked or steamed to produce a process stream that contains a cracked tar and particles contained therein.

The hydrocarbon feed is blended, mixed, or otherwise combined with a fluid (e.g., utility fluid or one or more solvents), typically provided via line 104, to form a fluid-feed mixture. For example, the tar stream can be blended with the utility fluid to reduce viscosity of the tar stream and produce a fluid-feed mixture that contains the tar, the particles, and the utility fluid.

Solids or particles (e.g., pyrolytic coke particles, polymeric coke particles, inorganic fines, and/or other solids) in the fluid-feed mixture may optionally be separated in filtration unit 106 before entering a first separation stage 108 (stage 108 containing at least one centrifuge) via inlet 110. The centrifuge of the first separation stage 108 applies heat and a centrifugal force to the fluid-feed mixture sufficient to form a higher density portion and a lower density portion. For example, the fluid-feed mixture can be heated at a temperature of greater than 60° C. and centrifuged to produce a lower density portion that contains the cracked tar and the utility fluid.

An extract containing the higher density portion may exit stage 108 via line 112, e.g., for storage, disposal, or further processing. A raffinate containing the lower density portion exits stage 108 via line 114. In some examples, the extract contains a greater portion of the particles than the raffinate. The extract can be a pellet or condensed to form a pellet that includes the particles. In one or more examples, the fluid-feed mixture has a first concentration of the particles having a size of greater than 25 μm and the lower density portion has a second concentration of the particles having a size of greater than 25 μm. The second concentration can be in a range from about 50% to about 99.9% of the first concentration.

Optionally, the raffinate is filtered in a second filtration unit 116 before entering optional second separation stage 118. Optional second separation unit 118 preferably separates from the raffinate a fluid-enriched stream 120 that may be recycled to the process, e.g., to fluid line 104. A second raffinate, which typically, but not necessarily (particularly where solvent assisted hydroprocessing is desired), contains the remainder of the first raffinate after separation of the fluid-enriched stream can exit the optional second separation unit via line 122. The second raffinate can be removed from the process, e.g., for storage and/or further processing, such as blending with other hydrocarbon feed or fuel oil.

Figure 2:
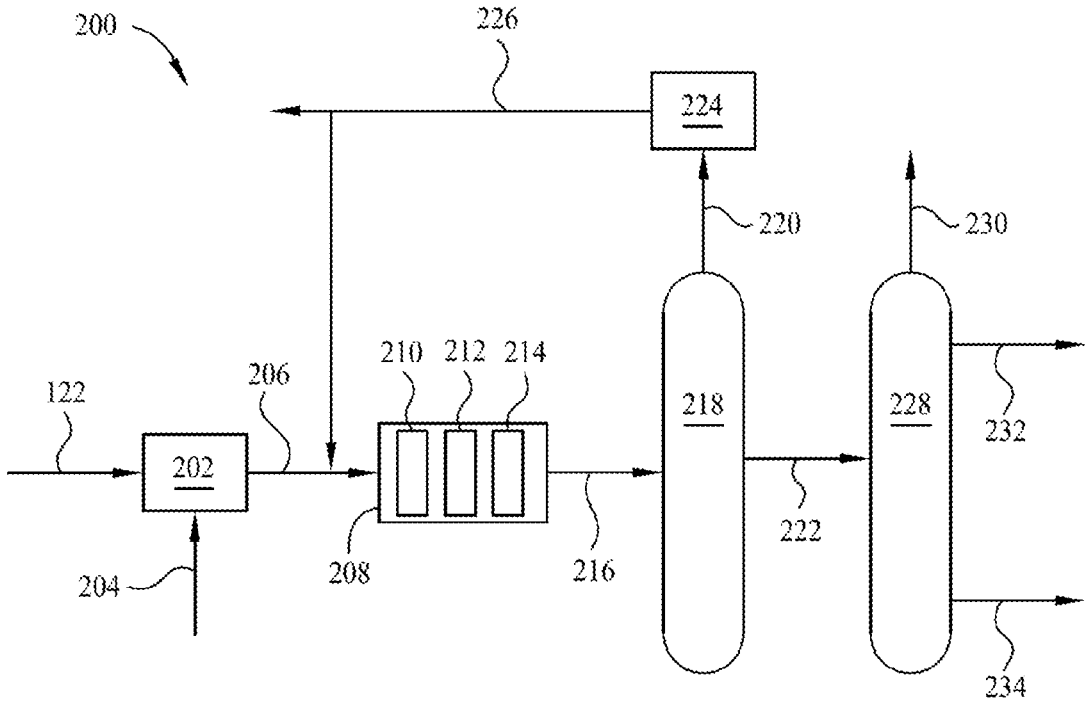
FIG. 2 depicts another process for improving hydrocarbon feedstock, according to one or more embodiments.

With continuing reference to FIG. 1, FIG. 2 schematically illustrates a process 200. In FIG. 2, the contents in line 122 (e.g., the second raffinate) may be conducted to preheat stage 202. A treat gas containing molecular hydrogen is obtained from one or more conduits 204. Optionally, the treat gas is heated before it is combined with the second raffinate. The treat gas can be combined with the second raffinate in stage 202, as shown in the figure, but this is not needed. In other aspects, at least a portion of the treat gas is combined with the second raffinate upstream and/or downstream of stage 202. The mixture of second raffinate+treat gas is then conducted via conduit 206 to hydroprocessing stage 208. Mixing means can be utilized for combining the pre-heated second raffinate mixture with the pre-heated treat gas in hydroprocessing stage 208, e.g., mixing means may be one or more gas-liquid distributors of the type conventionally utilized in fixed bed reactors. The mixture is hydroprocessed in the presence of optional primer fluid, and one or more of the specified hydroprocessing catalysts, the hydroprocessing catalyst being deployed within hydroprocessing stage 208 in at least one catalyst bed 210. Additional catalyst beds, e.g., 212, 214 with intercooling quench using treat gas, from conduit 202, can be provided between beds, if desired. The hydroprocessing conditions and choice of primer fluid, and when one is utilized, can be the same as those specified in U.S. Pat. No. 9,809,756.

Hydroprocessed effluent is conducted away from stage 208 via conduit 216 to a third separation stage 218 for separating from the hydroprocessor effluent (i) a vapor-phase product 220 (the total vapor product, which contains, e.g., heteroatom vapor, vapor-phase cracked products, unused treat gas, or any combination thereof) and (ii) a liquid-phase product 222 which contains, e.g., recoverable fluid and hydroprocessed product, such as hydroprocessed tar. Third separation stage 218 can include one or more conventional separators, e.g., one or more flash drums, but embodiments are not limited thereto. In a particular aspect, the amount (determined at room temperature) of liquid-phase product is about 95 wt % of the total liquid feed (combined fluid and hydrocarbon feed from conduit 110) to hydroprocessing stage 208.

The vapor-phase product may be conducted away from stage 218 via conduit 220 for further processing, e.g., to upgrading stage 224, e.g., for $H_2S$ removal. Molecular hydrogen obtained from stage 224, optionally in the presence of light hydrocarbon vapor and other vapor diluent, can be re-cycled for re-use as a treat gas component via conduit 226 to the hydroprocessing stage 208.

The liquid-phase product, which typically constitutes the remainder of the hydroprocessed effluent, is conducted away from stage 218 via conduit 222 to fourth separation stage 228. A bottoms stream containing from about 20 wt % to about 70 wt % of the liquid phase conducted to stage 228 can be separated and carried away via conduit 234, e.g., for storage and/or further processing, such as blending with a second hydrocarbon. A second vapor phase, which includes, e.g., an overhead stream containing from 0 wt % to about 20 wt % of the liquid phase, can be separated and carried away via conduit 230. The second vapor phase, which is primarily vapor dissolved or entrained in the liquid phase 222, typically contains $C_4$-fuel gas, which may optionally be combined with vapor phase product in conduit 220. A fluid-enriched stream containing recoverable fluid is separated and conducted via conduit 232 for re-cycle and re-use to mix with the hydrocarbon feed, e.g., in line 102.

Experimental

A solid sample recovered during a plant centrifuge test was used for samples during the following tests and experiments. It was discovered that about 30 wt % of the solid sample dissolved or reacted away at about 250° C. by heating a mixture of solids with toluene, while about 80 wt % of the solid sample dissolved or reacted away at about 350° C.

Advanced characterization was performed to understand the nature of solids. It turns out a significant fraction of solids are polymeric solids with multi-core structures, e.g., tar asphaltenes-like polymers. The solvent not only helps in dissolving smaller aromatics in solids but also dilutes the smaller cracked molecules after treatment of organic solids at higher temperature (e.g., about 300° C. to about 350° C.). The dilution effect avoids reformation of organic solids when cooled to ambient temperature.

A tar sludge sample collected during the extended centrifuge reliability test was mixed with $CS_2$, filtered through 1.5 μm filter and dried at about 110° C. Approximately 10 grams of solids were recovered from the sludge. Samples 1-4 were prepared—each containing about 0.5 gram of the collected solids mixed with about 50 mL of toluene. Each mixture was sealed in a stainless steel bomb under about 500 psi of nitrogen. Each of Sample 1-4 was heated to predetermined temperature and maintained at the temperature for 30 min. Samples 1, 2, 3, and 4 were heated to 250° C., 270° C., 300° C., 350° C., respectively. For each Sample 1-4, the residue solids were recovered by filtration after cooling down the sample to ambient temperature. The toluene solution was rotavapped to remove toluene. The viscous sludge-like material remaining after rotavapping was recovered and characterized.

TABLE 1

| Sample | Temperature (° C.) | Solids Loss (wt %) |
|---|---|---|
| 1 | 250 | 25 |
| 2 | 270 | 42 |
| 3 | 300 | 60 |
| 4 | 350 | 80 |

Table 1 shows the solids loss—presumably a result of dissolution into toluene—as a function of temperature. It was determined about 25 wt %, about 42 wt %, about 60 wt %, about 80 wt % of the solids were dissolved and/or decomposed at 250° C., 270° C., 300° C., and 350° C., respectively. The solids did not reform after cooling to room temperature.

The TGA of parent solids and residue solids recovered after dissolution in toluene was prepared. In the parent solid, a substantial amount (estimated at >60 wt %) of the solids decomposed in inert nitrogen atmosphere, suggesting that majority of the solids is organic in nature. The H/C ratio for residue solids samples is shown in the Table 2. The H/C value of a standard sample (S1) was measured at ambient temperature (25° C.). The H/C values for Samples 1, 3, and 4 were measured at 250° C., 300° C., and 350 vC.

It is clear that the solids have high hydrogen content similar to organic polymer and are not hard pyrolytic coke (H/C<0.4).

TABLE 2

| Sample | Temperature (° C.) | H/C |
|---|---|---|
| S1 | 25 | 0.95 |
| 1 | 250 | 0.91 |
| 2 | 270 | — |
| 3 | 300 | 0.89 |
| 4 | 350 | 0.82 |

The TGA results suggest that at lower temperature (250° C.) most of the volatiles get dissolved in toluene and at higher temperatures (300° C.-350° C.) most of the molecules in solids get fragmented in addition to dissolution.

Therefore, these experiments suggests that about 80 wt % to about 85 wt % of solids in steam cracked tar is organic polymer in nature and contains 2-ring, 2.5-ring, and 3-ring, multicore structures linked with C2+ aliphatic bridge, as evidenced by the relatively high H/C ratio and lower density of tar solids.

Overall, embodiments provide processes that include the discovery to preferentially remove, particularly by controlling solvent concentration and temperature, certain higher density components (e.g., particles) in the hydrocarbon feed results in a feed having less impurities. Controlling solvent concentration and temperature dissolves and/or decomposes many, if not all, of the particles that tend to cause fouling of downstream centrifuges, catalysts, and other portions of the process system, allowing for acceptable yields by leaving useful components in the lower density portion.

All documents described herein are incorporated by reference herein for purposes of all jurisdictions where such practice is allowed, including any priority documents and/or testing procedures to the extent they are not inconsistent with this text, provided however that any priority document not named in the initially filed application or filing documents is not incorporated by reference herein. As is apparent from the foregoing general description and the specific aspects, while forms of the invention have been illustrated and described, various modifications can be made without departing from the spirit and scope of the invention. Accordingly, it is not intended that the invention be limited thereby. Likewise, the term "comprising" is considered synonymous with the terms "including" and "containing". Likewise whenever a composition, an element or a group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below.

What is claimed is:

1. A process for preparing a low particulate liquid hydrocarbon product comprising:

blending a tar stream comprising particles with a fluid and heating to a temperature of 250° C. or greater to produce a fluid-feed mixture comprising tar, the particles, and the fluid;

wherein the fluid-feed mixture comprises about 20 wt % or greater of the fluid, based on a combined weight of the tar stream and the fluid; and wherein about 25 wt % to about 99 wt % of the particles in the tar stream are dissolved or decomposed when producing the fluid-feed mixture.

2. The process of claim 1, wherein the tar stream and the fluid are blended together and heated to a temperature of 280° C. to about 500° C. to produce the fluid-feed mixture.

3. The process of claim 1, wherein the tar stream and the fluid are blended together and heated to a temperature of about 290° C. to about 400° C. to produce the fluid-feed mixture.

4. The process of claim 3, wherein the tar stream and the fluid are blended together and heated to a temperature of about 300° C. to about 350° C. to produce the fluid-feed mixture.

5. The process of claim 1, wherein about 40 wt % to about 95 wt % of the particles in the tar stream are dissolved or decomposed when producing the fluid-feed mixture.

6. The process of claim 1, wherein about 60 wt % to about 90 wt % of the particles in the tar stream are dissolved or decomposed when producing the fluid-feed mixture.

7. The process of claim 1, wherein the fluid-feed mixture comprises about 40 wt % to about 70 wt % of the fluid, based on the combined weight of the tar stream and the fluid.

8. The process of claim 1, wherein the fluid-feed mixture comprises about 45 wt % to about 60 wt % of the fluid, based on the combined weight of the tar stream and the fluid.

9. The process of claim 1, wherein the fluid is a utility fluid and comprises a recycle solvent, a mid-cut solvent, or a combination thereof.

10. The process of claim 1, wherein the fluid comprises a solvent selected from the group consisting of benzene, toluene, ethylbenzene, trimethylbenzene, xylenes, naphthalenes, alkylnaphthalenes, tetralins, alkyltetralins, and any combination thereof.

11. The process of claim 1, wherein the fluid comprises about 20 wt % to about 80 wt % of toluene.

12. The process of claim 1, wherein the particles comprise polymeric asphaltene particles, polymeric coke particles, pyrolytic coke particles, inorganic fines, or any combination thereof.

13. The process of claim 1, further comprising heat soaking the tar stream prior to blending the tar stream and the fluid.

14. The process of claim 13, wherein the heat soaking of the tar stream further comprises exposing the tar stream to steam to produce the tar stream comprising a reduced reactivity tar.

15. The process of claim 1, further comprising separating the fluid-feed mixture to produce a higher density portion and a lower density portion.

16. The process of claim 15, wherein the fluid-feed mixture is separated by centrifugation, and wherein the lower density portion is substantially free of the particles of size greater than 25 μm.

17. A process for preparing a low particulate liquid hydrocarbon product comprising:

blending a tar stream comprising particles with a fluid and heating to a temperature of 300° C. or greater to produce a fluid-feed mixture comprising tar, the particles, and the fluid;

wherein the fluid-feed mixture comprises about 20 wt % or greater of the fluid, based on a combined weight of the tar stream and the fluid; and wherein at least 40 wt % of the particles in the tar stream are dissolved or decomposed when producing the fluid-feed mixture.

18. The process of claim 17, wherein the tar stream and the fluid are blended together and heated to a temperature of about 300° C. to about 350° C. to produce the fluid-feed mixture.

19. The process of claim 17, wherein about 50 wt % to about 95 wt % of the particles in the tar stream are dissolved or decomposed when producing the fluid-feed mixture.

20. The process of claim 17, wherein the fluid-feed mixture comprises about 45 wt % to about 60 wt % of the fluid, based on the combined weight of the tar stream and the fluid.

21. The process of claim 17, wherein the fluid comprises a solvent selected from the group consisting of benzene, toluene, ethylbenzene, trimethylbenzene, xylenes, naphthalenes, alkylnaphthalenes, tetralins, alkyltetralins, and any combination thereof.

22. The process of claim 17, further comprising heat soaking the tar stream prior to blending the tar stream and the fluid, wherein the heat soaking of the tar stream further comprises exposing the tar stream to steam to produce the tar stream comprising a reduced reactivity tar.

23. The process of claim 17, further comprising separating by centrifugation the fluid-feed mixture to produce a higher density portion and a lower density portion, wherein the lower density portion is substantially free of the particles of size greater than 25 μm.

24. A process for preparing a low particulate liquid hydrocarbon product comprising:

blending a tar stream comprising particles with a fluid and heating to a temperature of about 300° C. to about 400° C. to produce a fluid-feed mixture comprising tar, the particles, and the fluid;

wherein the fluid-feed mixture comprises about 20 wt % or greater of the fluid, based on a combined weight of the tar stream and the fluid; and wherein at least 50 wt % of the particles in the tar stream are dissolved or decomposed when producing the fluid-feed mixture.

25. A process for preparing a low particulate liquid hydrocarbon product comprising:

heat soaking a tar stream to produce an upgraded tar comprising particles;

blending the upgraded tar with a fluid to produce a fluid-tar mixture comprising ≥20 wt. % of the fluid based on the weight of the fluid-tar mixture, wherein the fluid comprises one or more of benzene, toluene, ethylbenzene, trimethylbenzene, xylenes, naphthalenes, alkylnaphthalenes, tetralins, and alkyltetralins;

heating the fluid-tar mixture to achieve a temperature ≥250° C. for at least 60 seconds to produce a heated fluid-tar mixture, wherein the heating decomposes and/or dissolves ≥25 wt % of the upgraded tar's particles;

separating a higher density portion and a lower density portion from the heated fluid-tar mixture, wherein (i) ≥50 wt. % of particles in the heated fluid-feed mixture having a density ≥1.05 g/mL are transferred to the higher density portion, (ii) ≤10% of the upgraded tar in the fluid-tar mixture is transferred to the higher-density portion, and (iii) the lower density portion is substantially free of the particles of size greater than 25 μm.

* * * * *